US006458010B1

(12) United States Patent
Yamagishi et al.

(10) Patent No.: US 6,458,010 B1
(45) Date of Patent: Oct. 1, 2002

(54) CURVING MECHANISM AND ROBOT

(75) Inventors: Takeshi Yamagishi, Kanagawa; Kazuhiro Kato, Tokyo, both of (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 09/673,510

(22) PCT Filed: Feb. 18, 2000

(86) PCT No.: PCT/JP00/00937

§ 371 (c)(1),
(2), (4) Date: Oct. 17, 2000

(30) Foreign Application Priority Data

Feb. 19, 1999 (JP) ..... 11-040969

(51) Int. Cl.[7] ..... A63H 11/00
(52) U.S. Cl. ..... 446/330; 446/390
(58) Field of Search ..... 446/352, 353, 446/332, 354, 355, 356, 276, 293, 294, 298, 361, 330, 390, 358, 383

(56) References Cited

U.S. PATENT DOCUMENTS 3,060,972 A * 10/1962 Sheldon
3,873,086 A * 3/1975 Lee ..... 472/57
4,224,759 A * 9/1980 Saint-Pierre et al. ..... 446/294
4,494,417 A * 1/1985 Larson ..... 74/469
4,571,208 A * 2/1986 Saigo et al. ..... 446/353
5,297,443 A * 3/1994 Wentz ..... 74/479 BF
5,324,225 A * 6/1994 Satoh et al. ..... 446/175
5,498,193 A * 3/1996 Locricchio ..... 446/361
5,701,878 A * 12/1997 Moore ..... 124/67

FOREIGN PATENT DOCUMENTS

| | | |
|---|---|---|
| JP | 24-1143 | 2/1949 |
| JP | 4-75892 | 3/1992 |
| JP | 4-329990 | 11/1992 |

* cited by examiner

*Primary Examiner*—Derris H. Banks
*Assistant Examiner*—Jamila Williams
(74) *Attorney, Agent, or Firm*—Frommer Lawrence & Haug LLP; William S. Frommer; Matthew K. Ryan

(57) ABSTRACT

An jointed tail of a pet robot can be configured simply and driven to curve freely and autonomously by fitting an jointed cylindrical member 25 around outer circumferences of two wire portions 24*a* and 24*b* composed of a wire 24 which is folded nearly into a shape of a hair pin, rotatingly driving two driven ends 24*d* and 24*e* on a side opposite to a tip 24*c* of the two wire portions 24*a* and 24*b* connected to each other around an X axis and a Y axis with a differential gear mechanism 38, and moving and controlling two driven ends 26*d* and 26*e* reversibly in an axial direction at a swing limit position around the X axis, thereby autonomously curving a tip of the wire 24.

7 Claims, 23 Drawing Sheets

SECTION C-C

SECTION C-C

CURVING MECHANISM AND ROBOT

TECHNICAL FIELD

The present invention relates to a curving mechanism and a robot, and is preferably applicable to a tail or the like of a miniature pet robot imitating a form of an animal such as a dog, a cat or the like.

BACKGROUND ART

Curving mechanisms which are to be applied to inserting sections of endoscopes and the like have conventionally been disclosed, for example, by Japanese Patent Laid-Open No. 6-320473 and No. 7-259725. an jointed curving pipe by a plurality of temperature control methods for shape memory alloys.

However, the curving mechanism which is configured to freely curve the jointed curving pipe by the plurality of temperature control methods for the shape memory alloys is inadequate as a curving mechanism for a tail or the like of a miniature pet robot imitating a form of an animal such as a dog or a cat since the curving mechanism requires a curving pipe which has a remarkably complicated configuration in itself and is expensive in addition to an expensive large control unit or the like.

DISCLOSURE OF THE INVENTION

The present invention has been achieved in view of points described above, and proposes a curving mechanism and a robot which have extremely simple structures and are nevertheless capable of more naturally expressing, for example, an autonomous curving action and the like of a tail of a miniature pet robot.

In order to solve such a problem, the present invention makes it possible to configure a jointed curving mechanism so as to be simple in a configuration, compact and inexpensive by fitting a jointed cylindrical member which can be curved over outer circumferences of a plurality of wires having connected tips and elasticity, and moving and controlling a plurality of driven ends of these wires selectively in an axial direction with an actuator.

Furthermore, the present invention makes it possible to obtain a curving mechanism which permits remarkably reducing the number of actuators, and is simple in a configuration, compact, inexpensive and optimum for application to a tail and the like of a miniature pet robot by fitting a cylindrical member which can be curved over outer circumferences of a plurality of wires having connected tips and elasticity, restricting a movable range of these wires in a direction perpendicular to an axial direction of the wires with the cylindrical member, and moving and controlling a plurality of driven ends on a side opposite to the tips of these wires selectively in the axial direction with an actuator, whereby these wires are moved in the axial direction relative to one another in the cylindrical member (a pulling operation and a pushing operation are performed simultaneously) and a tip of the cylindrical member is autonomously curved at the tips of the wires.

Furthermore, the present invention makes it possible to configure a curving mechanism which permits composing two wire portions of a single wire, is capable of carrying out a swinging drive and an autonomous curving drive of the wire in two directions perpendicular to each other with a single actuator, has a further simplified configuration and can be manufactured at a low cost by fitting a cylindrical member which can be curved over outer circumferences of two wire port-ions composed of a single wire folded nearly into a shape of a hair pin, rotating and controlling two driven ends of these two wire portions simultaneously in two directions perpendicular to an axial direction of the wire portions with an actuator, and moving and controlling these two driven ends reversibly in the axial direction.

Furthermore, the present invention makes it possible to configure a curving mechanism which permits composing two wire portions of a single wire, is capable of carrying out a swinging drive and an autonomous curving drive of the wire in two directions perpendicular to each other with a single actuator, has a much more simplified configuration and can be manufactured at a low cost by fitting a jointed cylindrical member which can be curved over outer circumferences of two wire portions composed of a single wire folded nearly into a form of a hair pin, rotating and controlling two driven ends of these two wire portions simultaneously in two direction perpendicular to an axial direction of the wire portions with an actuator, and moving and controlling these two driven ends reversably in the axial direction.

Furthermore, the present invention makes it possible to configure a curving mechanism which permits composing two wire portions of a single wire, is capable of carrying out a swinging drive and autonomous curving drive of the wire in two directions perpendicular to each other with a single actuator and has a further simplified configuration and can be manufactured at a low cost by fitting a jointed cylindrical member which can be curved in two directions perpendicular to each other over outer circumferences of two wire portions composed of a single wire folded nearly in a shape of a hair pin, rotating and controlling two driven ends of the two wire portions with an actuator simultaneously in two directions perpendicular to an axial direction of the two wire portions and moving and controlling these two driven ends reversibly in the axial direction.

Furthermore, the present invention makes it possible to configure a curving mechanism which is capable of easily carrying out a rotating control of a cylindrical member together with a wire around first and second centers of rotation and a control to autonomously curve a tip of the wire around a second center of rotation by a rotating control of a differential gear mechanism with a single actuator, has a compact configuration as a whole, is light in weight and can be manufactured at a low cost by fitting a cylindrical member which can be curved in directions perpendicular to each other over outer circumferences of two wire portions composed of a single wire folded nearly into a shape of a hair pin, building a differential gear mechanism in a gear box which is composed so as to be rotatable around a first center of rotation, disposing a slide guide which is rotatable around the first center of rotation and two sliders which are composed so as to be slidable along the slide guide in a direction perpendicular to a second center of rotation between first and second gears which are rotated around a second center of rotation perpendicular to the first center of rotation of the differential gear mechanism, fixing two driven ends on a side opposed to a tip of the two wire portions to the two sliders, rotatingly driving the first gear of the differential gear mechanism around the second center of rotation in the gear box with an actuator so that the two sliders can be rotated together with the slide guide around the second center of rotation between two stoppers of the gear box with two wire driving parts disposed on the first gear of the differential gear mechanism and configuring the first gear so that it can be rotatingly driven together with the gear box also around the first center of rotation.

Furthermore, the present invention makes it possible to provide a pet robot which has the above described curving mechanism built in jointed members such as a tail of the robot, thereby being capable of swinging and autonomously curving the tail of the robot in two up-down and right-left directions, expressing feelings, emotions and the like imitating those of a dog or a cat with more natural actions and being full of expressions.

BEST MODE FOR CARRYING OUT THE INVENTION

An embodiment of the present invention will be described in detail below with reference to the accompanying drawings.

(1) Description of Pet Robot

Figure 23:
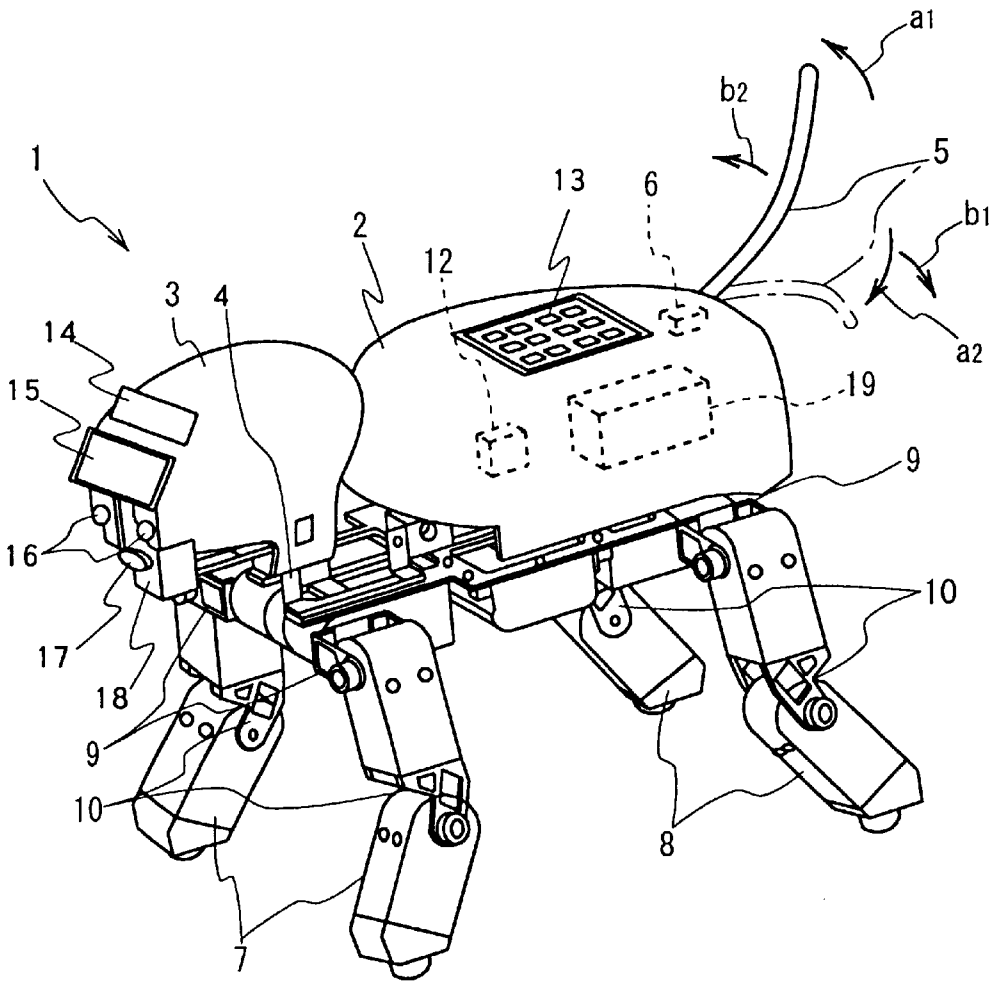
FIG. 23 is a perspective view of a pet robot which comprises the curving mechanism according to the present invention built in a tail.

First, FIG. 23 shows a miniature pet robot 1 imitating a quadruped animal such as a dog or a cat, for example, wherein a head member 3 is mounted at a front end of a body member 2 by way of a neck joint 4 so as to be rotatable in two up-down and right-left directions, a tail 5 is attached to a rear portion of the body member 2 by way of a tail joint 6 so as to be rotatable in the two up-down and right-left directions, and two forelegs 7 and two hind legs 8 are attached to two front and rear portions of the body member 2 by way of a shoulder joint 9 and a knee joint 10 respectively so as to be rotatable in the two up-down and right-left directions. A main control unit (micro computer) 12 is built in the body member 2 and a key input unit 13 which allows various kinds of required data to be input with manual operations is attached to a top surface of the body member 2. Furthermore, a touch sensor 14, an image display unit 15, an image recognition unit 16, a loudspeaker 17, an infrared ray control unit 18 and the like are attached to the head member 3, whereas a telephone unit 19, microphone (not shown) and the like are built in the body member 2 and the head member 3.

With the main control unit 12 which drives a total of four forelegs 7 and hind legs 8 so as to fold and stretch the forelegs 7 and the hind legs 8, the gressorial robot 1 can lie sprawled and stand up by itself.

By moving the forelegs 7 and the hind legs 8 for walking, the gressorial robot 1 can walk by itself. Furthermore, with the main control unit 12 which drives the head member 3 and the tail 5, the gressorial robot 1 can freely swing the head member 3, the tail 5, the forelegs 7 and the hind legs 8 upward, downward, rightward, leftward, etc., thereby being capable of expressing performance such as movements and humorous gestures like those of a quadruped animal such as a dog or a cat. When a user touches the touch sensor 14 on the head member 3, the gressorial robot 1 is capable of similarly expressing an action of joy by shaking the head member 3 and the tail 5, and lifting one of the forelegs 7 as an expression of giving a paw. The image display unit 15 is capable of displaying a face of a partner talking over the telephone unit, for example, during telephone communication and the image recognition unit 16 is capable of recognizing an obstacle during walking so that the gressorial robot 1 can avoid the obstacle and safely walk to a target location or picking up a face of a user of the telephone unit 19 during the telephone communication and transmitting the face to the speaking partner. The loudspeaker 17 is capable of making cries such as "bowwow" and "mew" of an animal such as a dog or a cat, whereas the infrared ray control unit 18 is capable of controlling various kinds of infrared ray control appliance such as a television set and a video tape recorder.

A curving mechanism 21 which is described below is applied to the tail 5 of the pet robot 1, and configured to be capable of autonomously swinging the tail 5 not only in a direction indicated by arrows a1 and a2 which is an up-down direction but also in a direction indicated by arrow b1 and b2 which is a right-left direction so that the pet robot 1 is capable of expressing feeling and emotions imitating those of a quadruped animal such as a dog or a cat with more natural actions.

(2) Description of Curving Mechanism

Now, a first embodiment of the curving mechanism 21 which is applied to the tail 5 of the pet robot 1 will be described with reference to FIGS. 1 through 21.

Describing first of a fundamental configuration of the jointed curving mechanism 21 shown in FIGS. 1 through 6, a spherical gear box 23 is disposed in a base unit 22 which is mounted on a chassis 2*a* of a body member 2 of the pet robot 1. The jointed curving mechanism 21 is attached to a portion of an outer circumference of the gear box 23 and composes a tail 5 of the pet robot 1, and the gear box 23 is configured as a tail joint 6.

A wire 24 which has elasticity, for example a wire made of an alloy having super elasticity, is used in the curving mechanism 21. The wire 24 is folded nearly into a U shape (or V shape) at a center in a longitudinal direction so as to form two wire portions 24*a* and 24*b* which are nearly in parallel with each other, whereby the wire 24 nearly has a shape of a hair pin which is composed of the wire portions 24*a* and 24*b* having a tip 24*c* connected nearly in the U shape (V shape). Base ends which are on a side opposite to the tip 24*c* of the two wire portions 24*a* and 24*b* are formed as two driven ends 24*d* and 24*e* having L shapes folded symmetrically upward and downward.

Fitted over an outer circumference of the wire 24 nearly having the shape of the hair pin is a cylindrical member 25 which can be curved and is configured as a jointed mechanism consisting of a plurality of, for example four, cylinders 26*a* through 26*d* made of a molded synthetic resin material or light metals and a plurality of, for example three joints 27 bendably connecting the cylinders 26*a* through 26*d* adjacent to one another. The cylindrical member 25 is configured in a form of an elongated cone having a diameter which is gradually enlarged from the cylinder 26*a* located at a tip toward the cylinder 26*d* located at a base end on a side opposite to the tip and an outside diameter of the tail 5 of the pet robot 1 is designed by the cylindrical member 25. At a location close to a tip of the cylinder 26*a* located at the tip, a temporary stopper pin 28 is driven perpendicularly to the axial direction to prevent the cylindrical member 25 from coming off the wire 24, and the driven ends 24*d* and 24*e* of the two wire portions 24*a* and 24*b* protrude outward from the cylinder 26*d* located at the base end. Each of the three joints 27 of the cylindrical member 25 has a spherical surface 27*a* and a spherical seat 27*b* so as to compose the so-called spherical bearing (a kind of universal joint) which connects (contacts) the four cylinders 26*a* through 26*d* so as to be rotatable relative to one another in two directions indicated by the arrows a1, a2 and the arrows b1 b2 which are perpendicular to each other. Formed at a play end of the cylinder 26*d* located at the base end is a spherical seat 27*b* which corresponds to an outer circumferential spherical surface of the gear box 23.

Figure 5:
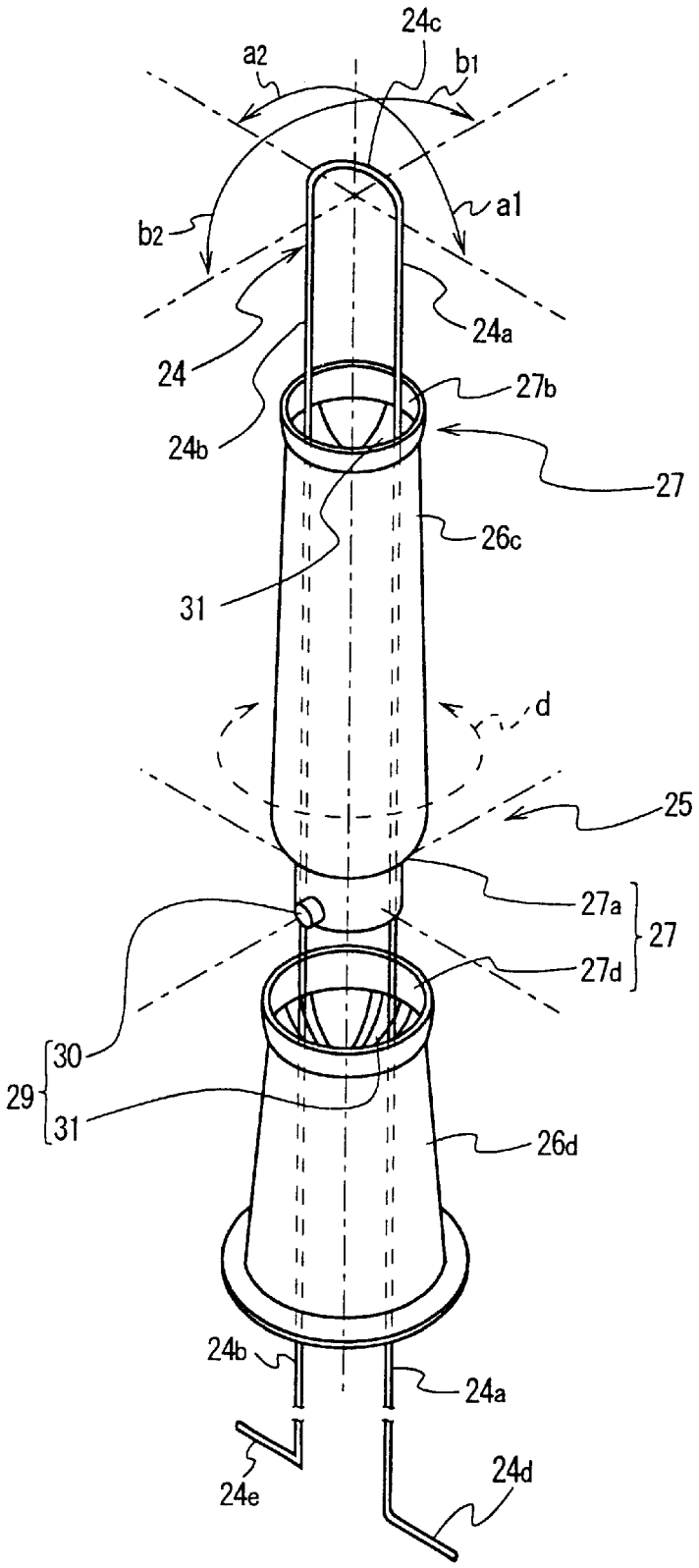
FIG. 5 is an exploded perspective view of a condition seen from an upside descriptive of an joint portion of the first embodiment of the above curving mechanism.
Figure 6:
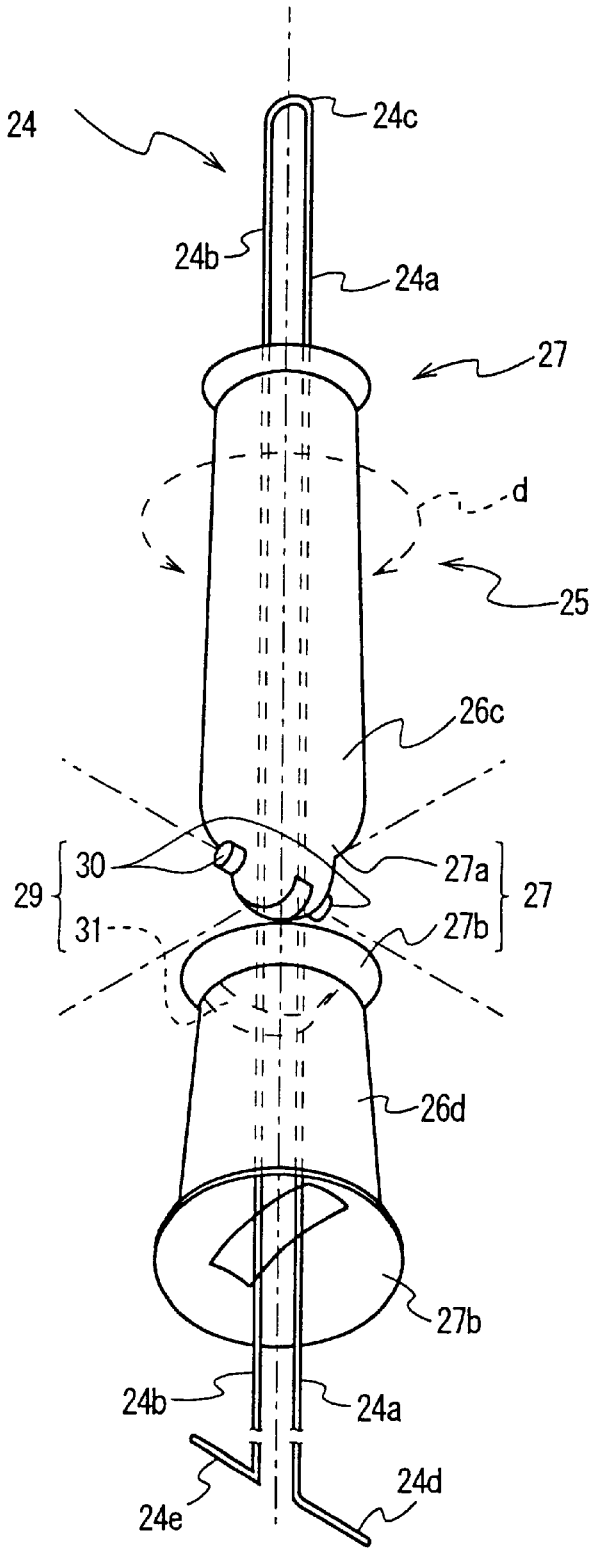
FIG. 6 is a perspective view in a condition as seen from a downside descriptive of the joint portion of the first embodiment of the above curving mechanism.
Figure 7:
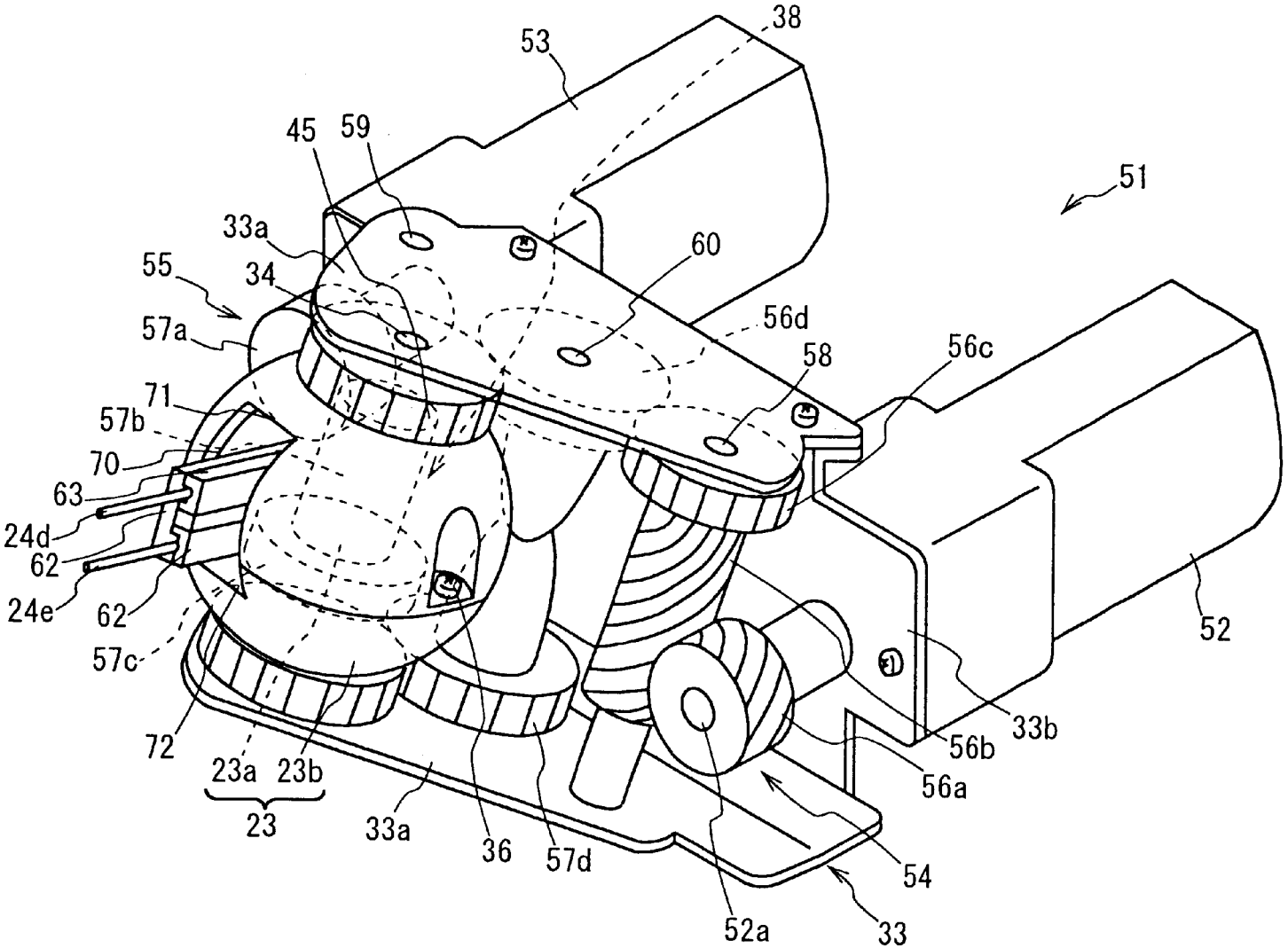
FIG. 7 is a perspective view descriptive of a gear box and an actuator in the first embodiment of the above curving mechanism.
Figure 8:
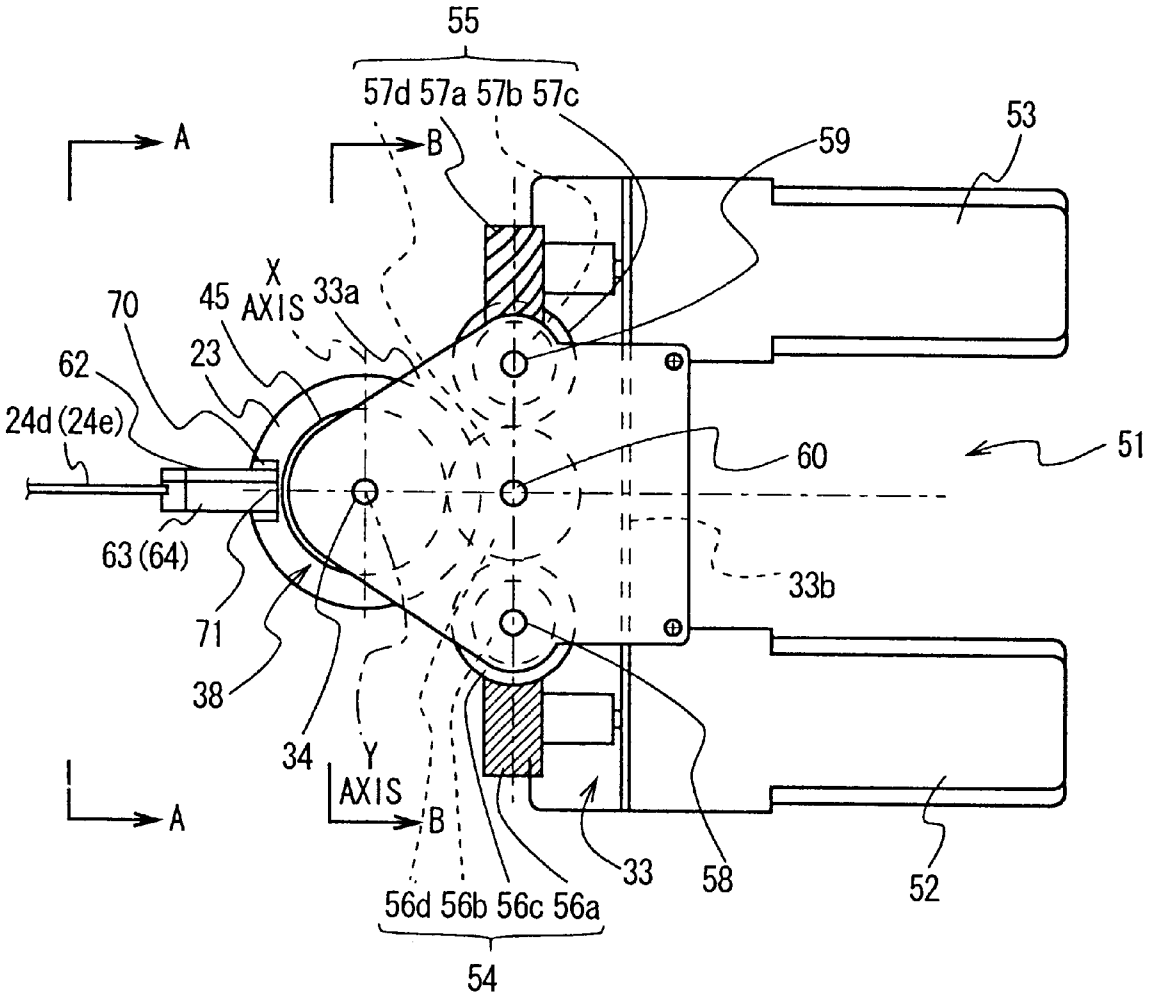
FIG. 8 is a plan view of FIG. 7.
Figure 9:
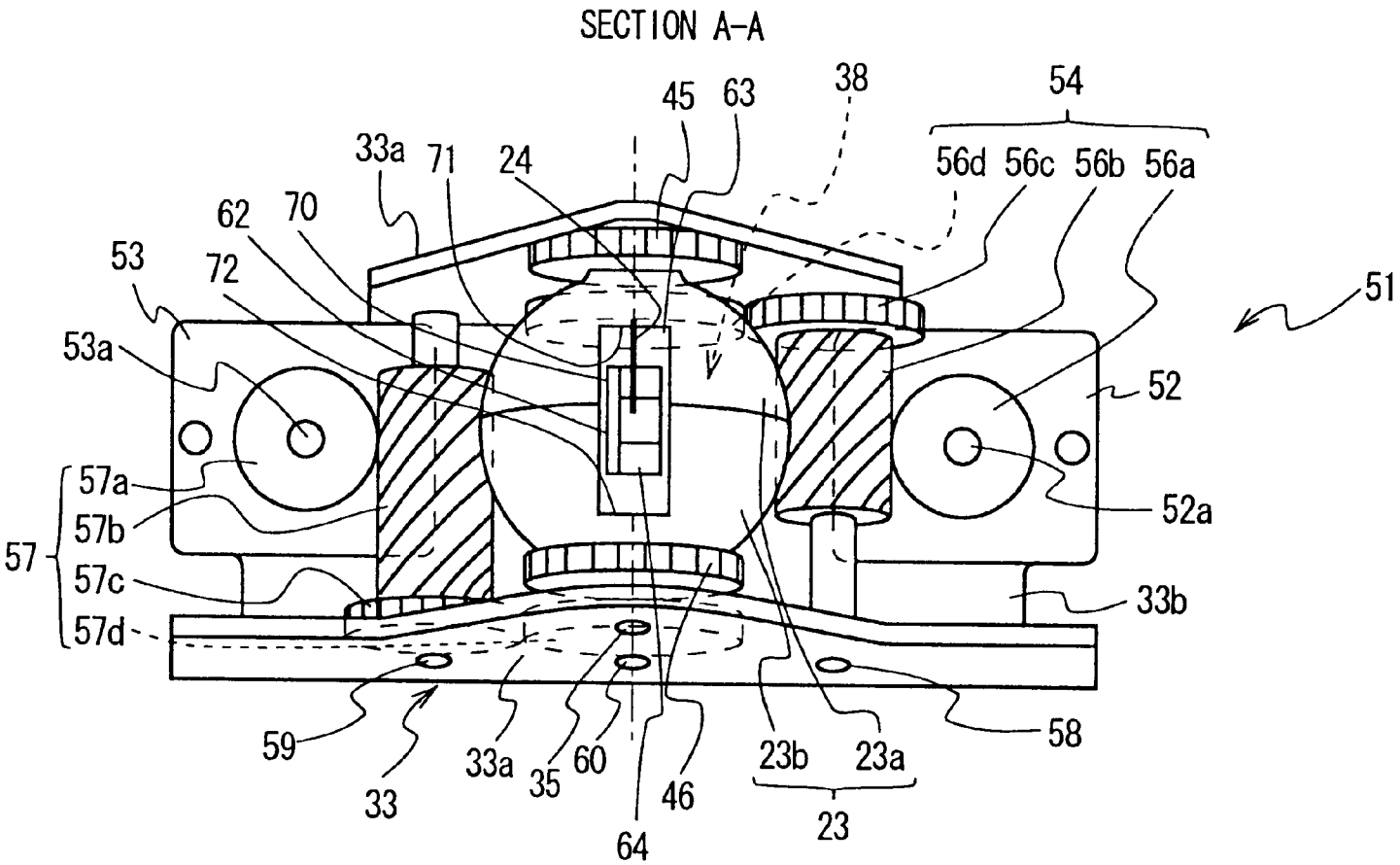
FIG. 9 is a sectional view taken along an A—A line in FIG. 8.
Figure 10:
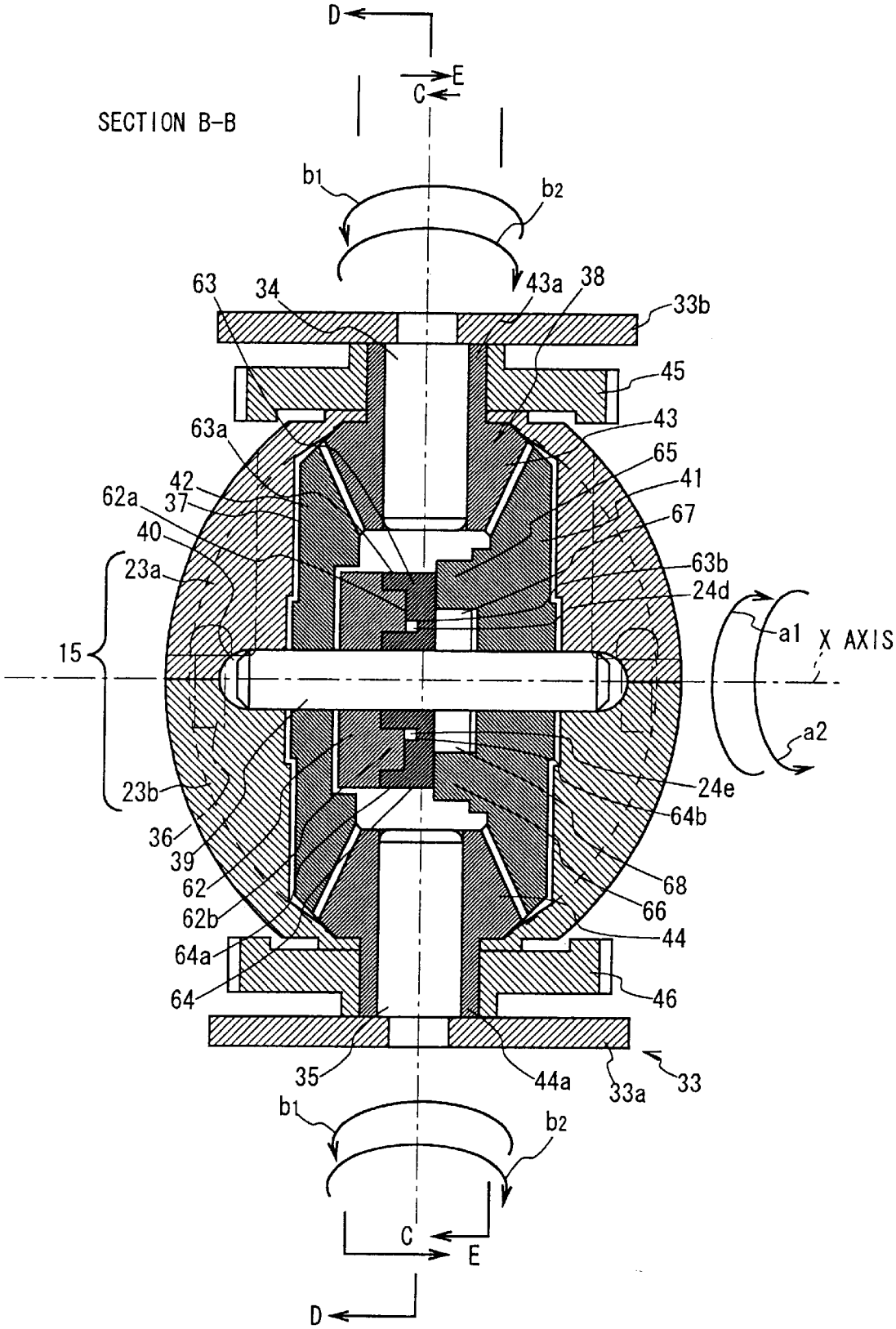
FIG. 10 is an enlarged sectional view taken along a B—B line in FIG. 8 descriptive of a differential gear mechanism in the gear box in the first embodiment of the above curving mechanism.

When the four cylinders 26*a* through 26*d* happen to rotate relative to one another around the axial direction as indicated by an arrow d traced in a dotted line in FIGS. 5 and 6, however, the two internal wire portions 24*a* and 24*b* are twisted and the three joints 27 are equipped with rotation preventive means 29 which prevent these cylinders 26*a* through 26*d* from rotating relative to one another around the axial direction in the direction indicated by an arrow c. As an example of the rotation preventive means 29, the embodiment adopts a structure wherein a stopper 30 formed on a side of a spherical surface 27*a* in a direction perpendicular to the axial direction is rotatably engaged with a groove 31 formed along the spherical seat 27*b* in a direction perpendicular to the axial direction, but the rotation preventive means 29 may be another structure wherein concave and convex surfaces, for example, are formed on the spherical 27*a* and the spherical seat 27*b* in circumferential directions of these members.

Figure 1:
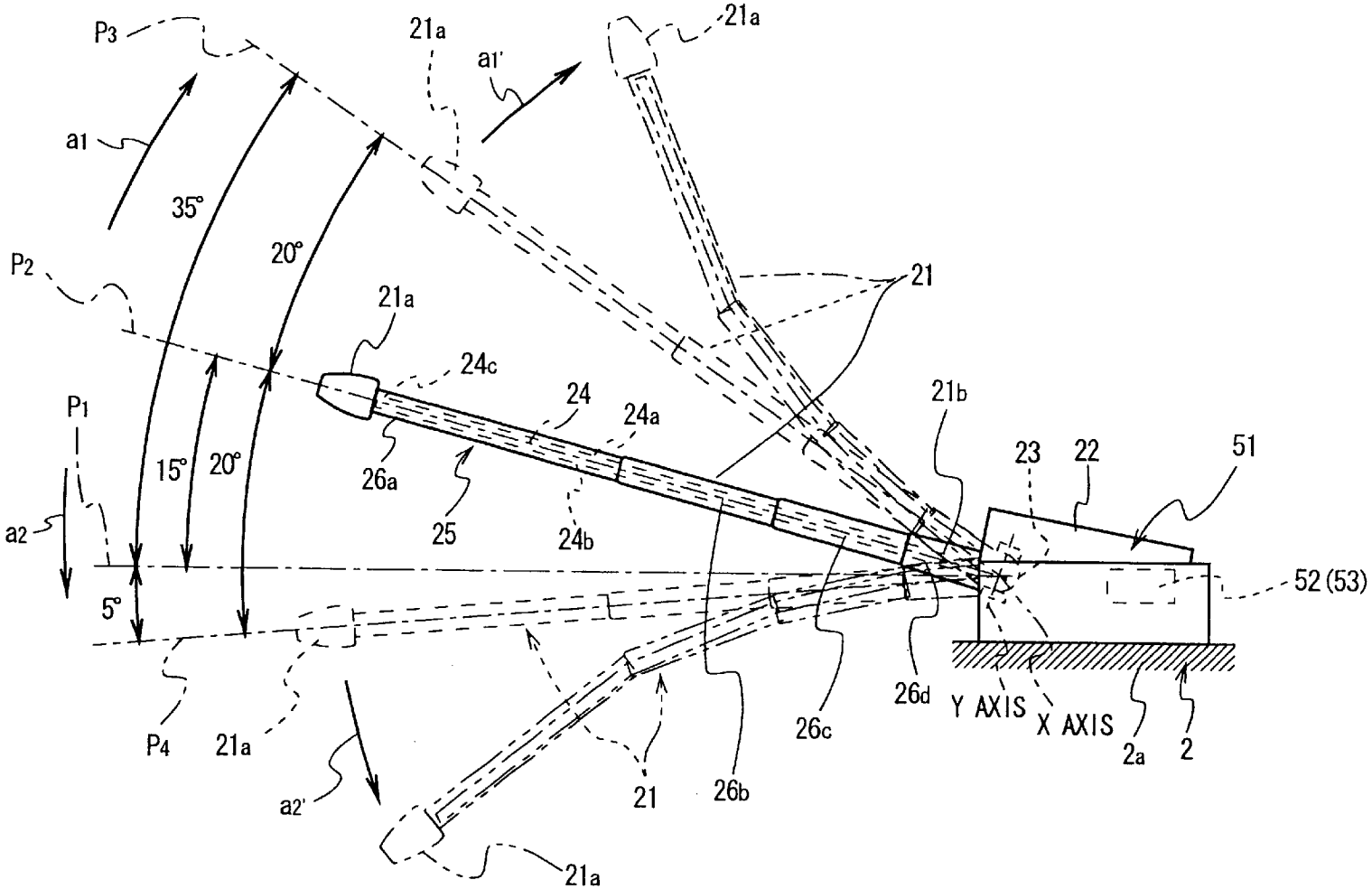
FIG. 1 is a side view showing an external appearance form of a first embodiment of a curving mechanism wherein the present invention is applied to a tail of a miniature pet robot.
Figure 2:
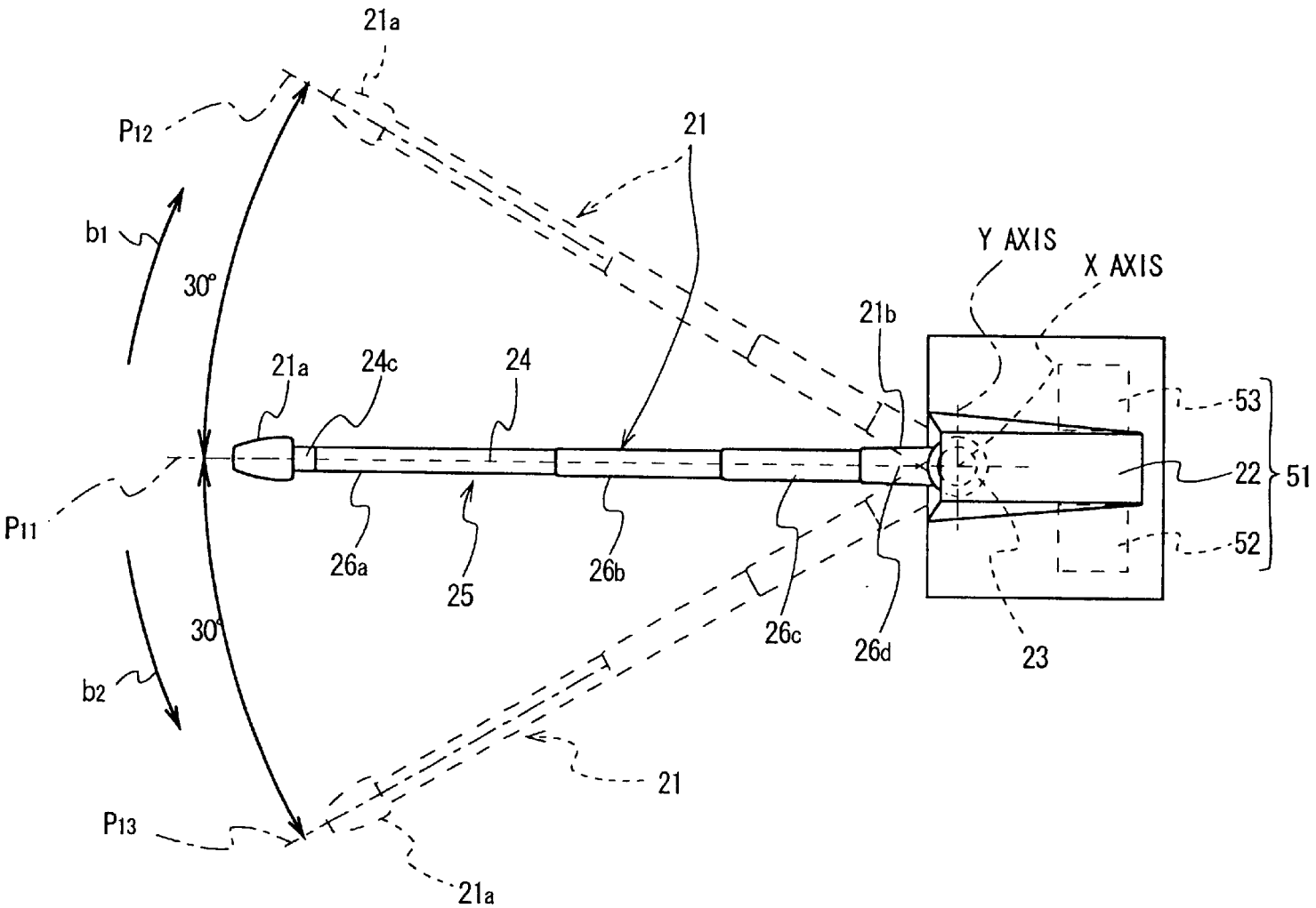
FIG. 2 is a plan view showing the external appearance form of the first embodiment of the above curving mechanism.
Figure 11:
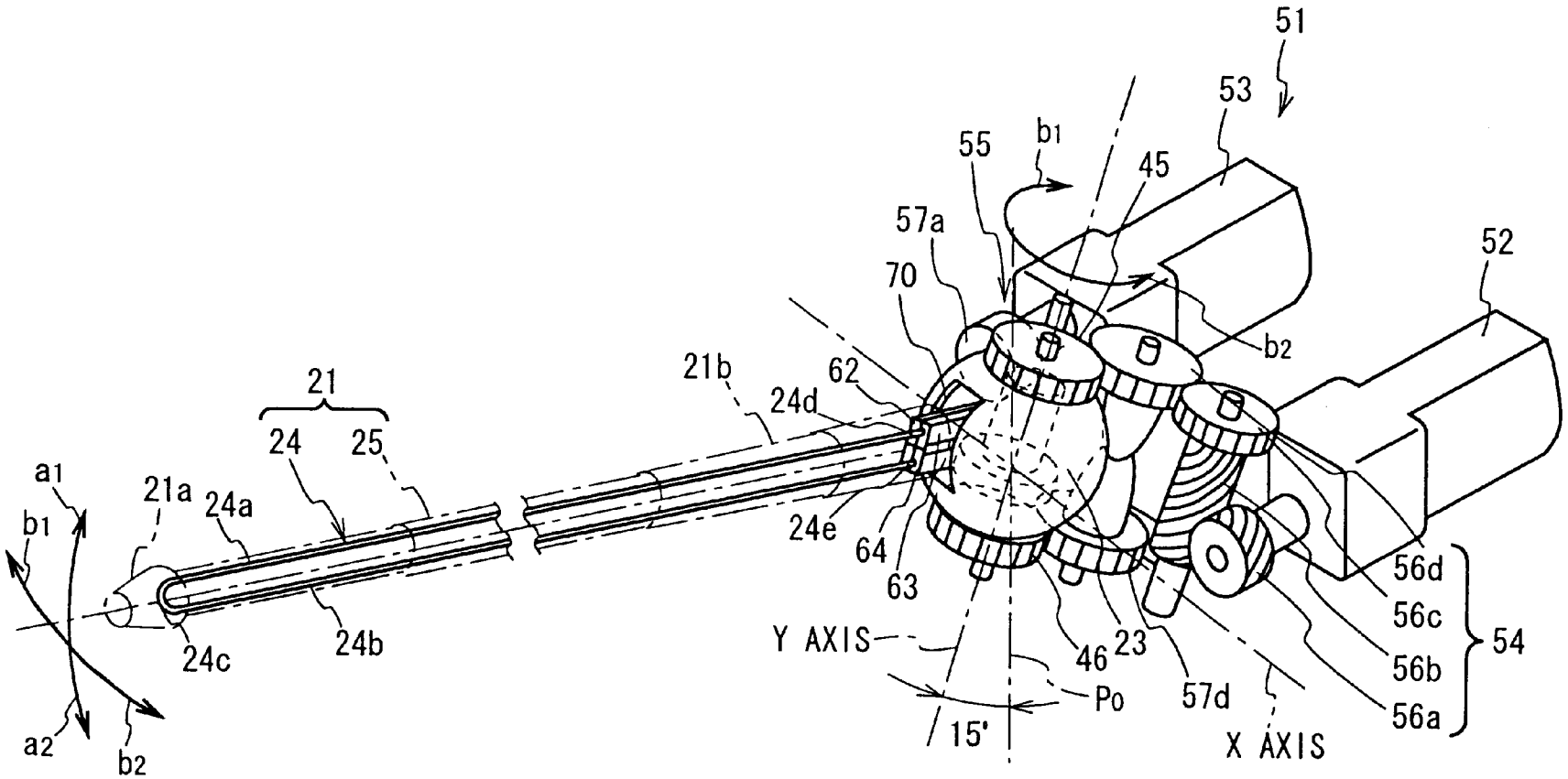
FIG. 11 is a perspective view of the above curving mechanism and the actuator as a whole.
Figure 12:
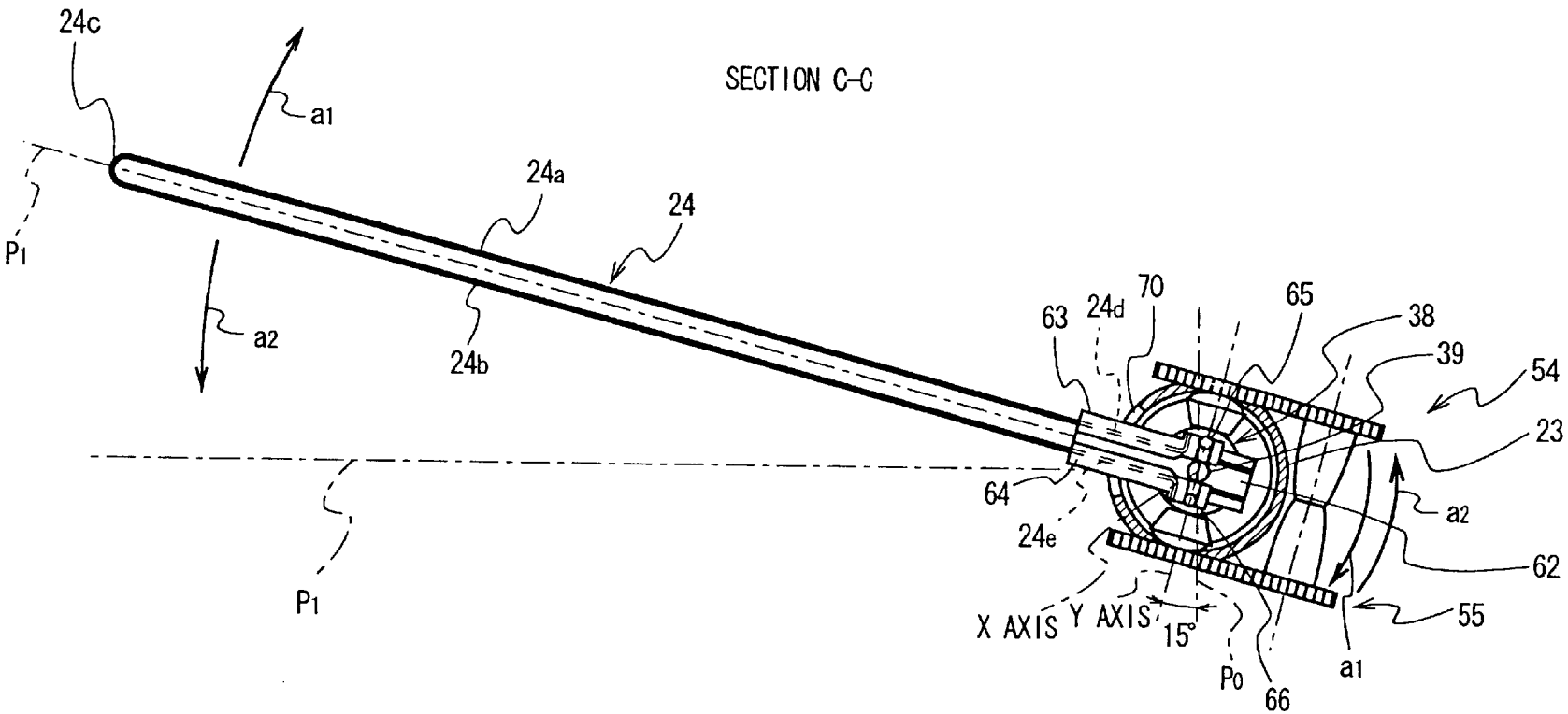
FIG. 12 is a sectional side view taken along a C—C line in FIG. 10 showing a condition where the above curving mechanism and the differential gear mechanism as a whole are at a swing center position in an up-down direction.

The curving mechanism 21 has the fundamental structure described above, a Y axis in a vertical direction corresponding to the first center of rotation and an X axis in a horizontal direction corresponding to the second center of rotation which are the two directions of the curving mechanism 21 intersecting perpendicularly with each other are set in the spherical gear box 23 which swingingly and curvingly drives the curving mechanism 21 in the two directions indicated by the arrows a1 and a2 and b1 and b2 which intersect perpendicularly with each other as shown in FIGS. 1 and 2, and these X axis and Y axis intersect perpendicularly with each other at a center of the gear box 23. The Y axis is inclined at a predetermined angle, for example a rearward inclination angle of 15°, on a vertical plane as shown in FIGS. 11 and 12. A base 21*b* on a side opposite to a tip 21*a* of the curving mechanism 21 is connected to the gear box 23 in a condition where the base 21*b* is perpendicular to the Y axis. However, the two wire portions 24*a* and 24*b* of the wire 24 are configured as perpendicular portions arranged vertically on the vertical plane including the Y axis, the two driven ends 24*d* and 24*e* of these wire portions are attached to a differential gear mechanism 38 described later disposed in the gear box 23 and the play end of the cylinder 26*d* at the base end of the cylindrical member 25 is kept by the spherical seat 27*b* in slidable contact with the outer circumferential spherical surface of the gear box 23.

A swinging range (a root angle) around the X axis of the curving mechanism 21 in the direction indicated by the arrows a1 and a2 which is the up-down direction is set at ±20° of a swinging center position P2 in the up-down direction which is set, for example, at an angle of elevation of 15°, for example, relative to a horizontal standard P1 (set at −5 to +35° relative to the horizontal standard P1) and a swinging range (a root angle) around the Y axis in the direction indicated by the arrows b1 and b2 which is the right-left direction is set, for example, at ±30° of a swinging center position P11 in the right-left direction.

The curving mechanism 21 is configured to be swingingly driven together with the wire 24 and the cylindrical member 25 in the direction indicated by the arrows b1 and b2 while maintaining perpendicular conditions of the two wire portions 24*a* and 24*b* of the wire 24 when the gear box 23 is rotatingly driven around the Y axis in the direction indicated by the arrows b1 and b2 as described later. Furthermore, the curving mechanism 21 is configured to be swingingly driven together with the wire 24 and the cylindrical member 25 in the direction indicated by the arrow a1 and a2 while maintaining a condition where parallelism is kept between the two wire portions 24*a* and 24*b* when the two driven ends 24*d* and 24*e* of the wire portions 24*a* and 24*b* of the wire 24 are rotatingly driven simultaneously around the X axis in the directions indicated by the arrows a1 and b1 in the gear box 23 by the differential gear mechanism 38 described later in a condition where the gear box 23 is stopped.

The differential gear mechanism 38 described later is configured to be capable of curvingly driving the curving mechanism 21 upward or downward further from an upper swing limit position P3 or a lower swing limit position P4 in a direction indicated by an arrow a1' or an arrow a2' as indicated by a single-dot chain line or a two-dot chain line in FIG. 1 by moving and controlling the two driven ends 24*d* and 24*e* of the wire 24 reversibly in the axial direction after the curving mechanism 21 reaches the upper swing limit position P3 or the lower swing limit position P4 while the differential gear mechanism 38 is swingingly driving the curving mechanism 21 in the direction indicated by the arrow a1 or the arrow a2 as shown in FIG. 1.

Figure 3:
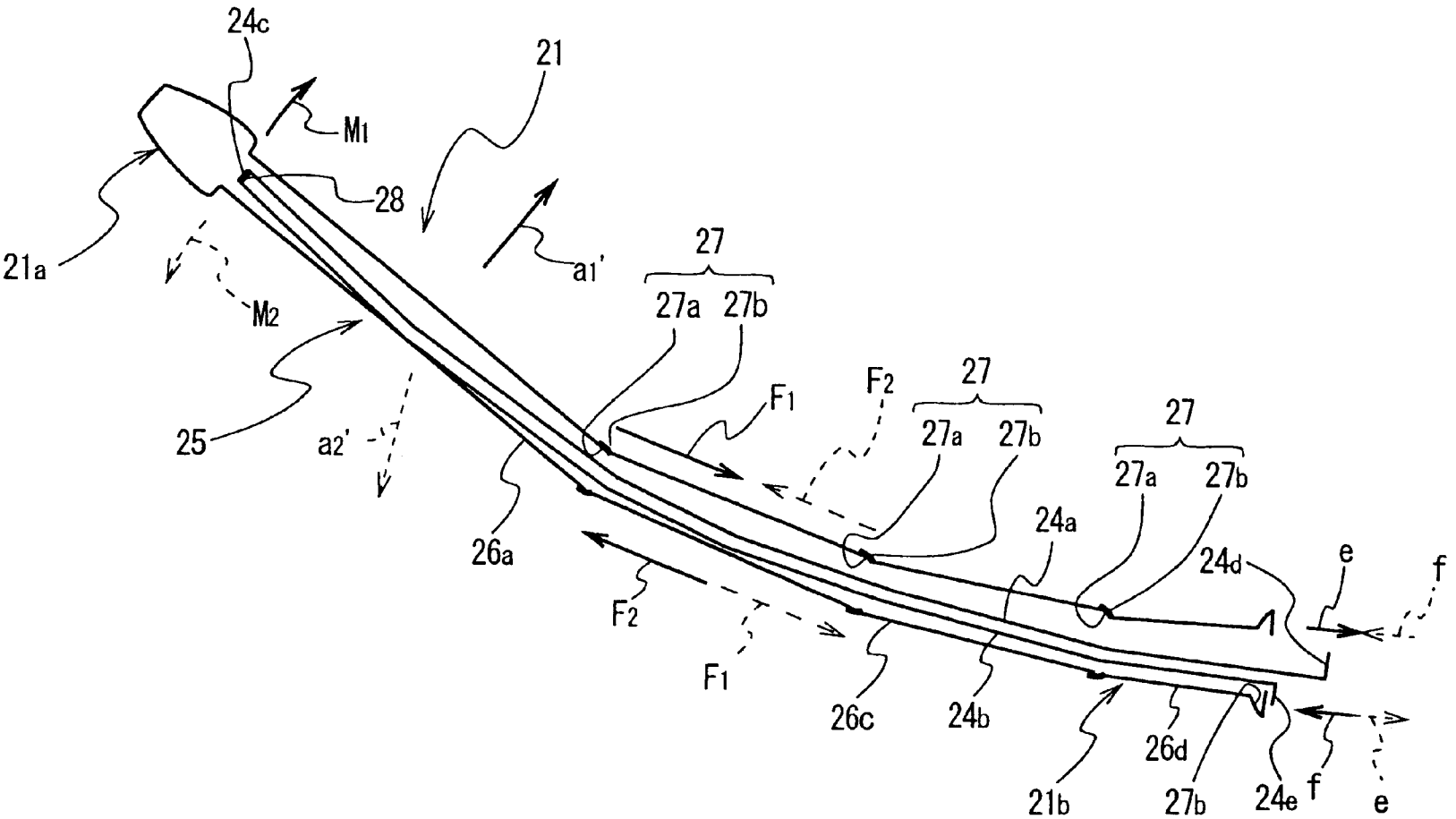
FIG. 3 is a schematic side view descriptive of an autonomous curving action of the first embodiment of the above curving mechanism.
Figure 4:
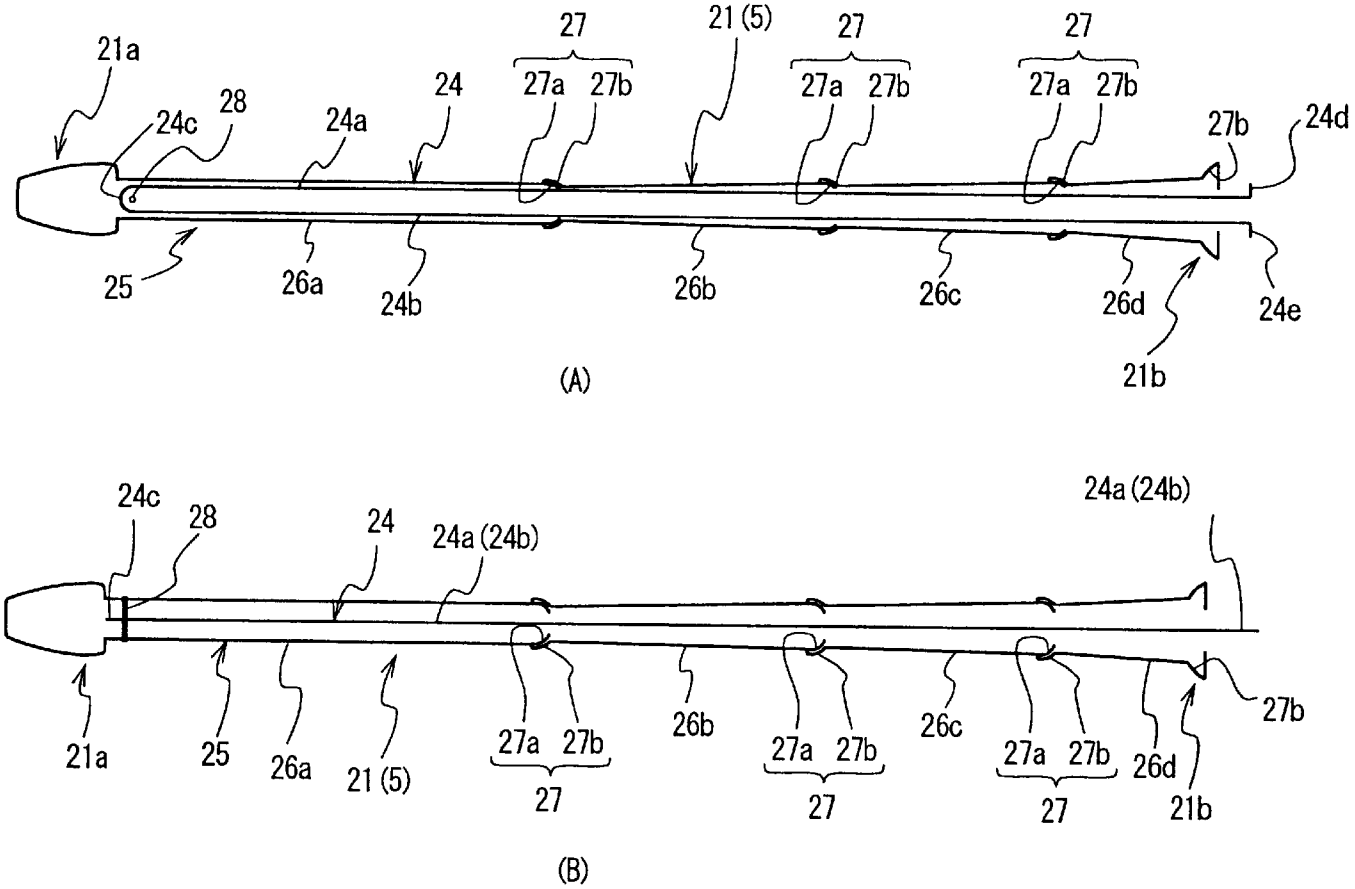
FIG. 4 is a side view and a plan view schematically showing sections of the first embodiment of the above curving mechanism.
Figure 14:
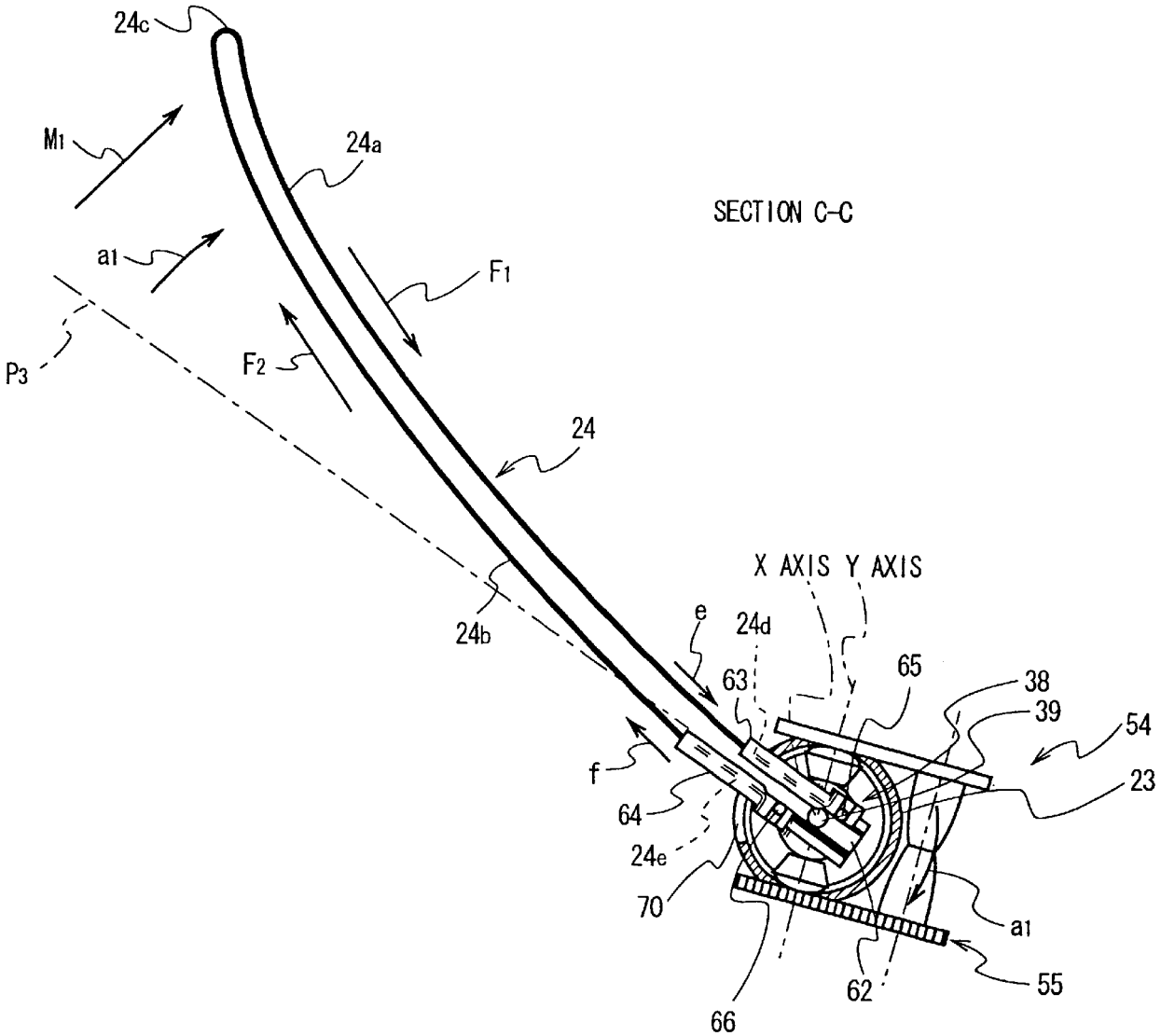
FIG. 14 is a sectional side view similar to FIG. 13 showing a condition where the curving mechanism shown in FIG. 13 is driven for autonomous curving upward from the upper swinging limit position.

When the curving mechanism 21 reaches the upper swing limit position P3 indicated by a chain line in FIG. 1 while being swingingly driven in the direction indicated by the arrow a1, the driven end 24*d* which is located higher out of the two driven end 24*d* and 24*e* of the two wire portions 24*a* and 24*b* of the two wire 24 is pulled by the differential gear mechanism 38 described later in a direction indicated by an arrow e which is the axial direction as shown in FIGS. 3 and 14 described later, whereas the driven end 24*e* which is located lower is simultaneously pushed out in a direction indicated by an arrow f which is the axial direction. Then, a pulling force F1 in the direction indicated by the arrow e and a pushing force F2 in the direction indicated by the arrow f are exerted simultaneously on the tip 24*c* of the two wire portions 24*a* and 24*b,* an upward moment M1 produced as a resultant force is exerted on the tip 24*c* of the two wire portions 24*a* and 24*b* in the cylindrical member 25, whereby the wire 24 automatically curves as a whole on the vertical plane in the direction indicated by an arrow a1' against elasticity of the wire, the cylindrical member 25 folds consecutively at the three joints 27 among the four cylinders 26*a* through 26*d* and the curving mechanism 21 curves as a whole in the direction indicated by the arrow a1' into an arc shape as indicated by the single-dot chain line in FIG. 1.

When the curving mechanism 21 reaches the lower swing limit position P4 indicated by a dotted line in FIG. 1 while being swingingly driven in the direction indicated by the arrow a2, the driven end 24*d* which is set higher out of the two driven ends 24*d* and 24*e* of the two wire portions 24*a* and 24*b* of the wire 24 is pushed out by the differential gear mechanism 38 described later in the direction indicated by the arrow f which is the axial direction as indicated by arrows traced in dotted lines in FIG. 3, whereas the driven end 24*e* which is set lower is pulled in the direction indicated by the arrow e which is the axial direction. Then, the pushing force F2 in the direction indicated by the arrow f and the pulling force F1 in the direction indicated by the arrow e are exerted simultaneously on the tip 24*c* of the two wire portions 24*a* and 24*b* in the cylindrical member 25 and a downward moment M2 produced as a resultant force is exerted on the tip 24*c* of the two wire portions 24*a* and 24*b,* whereby the wire 24 autonomously curves as a whole on the vertical plane against the elasticity in a direction indicated by an arrow a2', the cylindrical member 25 consecutively folds at the three joints 27 among the four cylinders 26*a* through 26*d* and the curving mechanism 21 autonomoulsy curves as a whole in the direction indicated by the arrow a2' into an arc shape as indicated by a two-dot chain line in FIG. 1.

When the curving mechanism 21 is swingingly driven in the direction indicated by the arrows b1 and b2 as shown in FIG. 2, the tip 24*c* of the two wire portions 24*a* and 24*b* of the wire 24 is curved in parallel in the direction indicated by the arrows bland b2 against the elasticity by an inertia force which is produced when the curving mechanism 21 reaches a left side swing limit position P12 or a right side swing limit position P13 and the cylindrical member 25 is curved together with the tip 24*c* in the direction indicated by the arrows b1 and b2.

In FIGS. 7 through 21 descriptive of an internal configuration of the base unit 22, a spherical gear box 23 is supported by a pair of upper and lower vertical support shafts 34 and 35 so as to be rotatable around the Y axis in the directions indicated by the arrows b1 and b2 between nearly triangular tip portions of a pair of upper and lower gear box mounting parts 33*a* of a chassis 33 which is configured to have a side surface nearly of a U shape, and a Y axis corresponding to a center of the pair of upper and lower support shafts 34 and 35 is inclined, for example, at a rearward inclination angle of 15° relative to a vertical standard P0 on the vertical plane as shown in FIG. 11. The gear box 23 is composed of a pair of upper and lower hemispherical members 23*a* and 23*b* which have forms of upper and lower halves of a sphere and tightly integrated with each other using a plurality of screws 36.

A hollow portion 37 which is perpendicular to the X axis and has a flat form is built in this gear box 23, and the differential gear mechanism 38 is built in the hollow portion 37.

Speaking concretely, a horizontal support shaft 39 which is disposed on the horizontal X axis intersecting perpendicularly with the Y axis at a center of the gear box 23 is arranged so as to horizontally run through a center of the hollow portion 37, and both right and left ends of the support shaft 39 are supported in a pair of right and left support holes 40 which are formed in upper and lower divided surfaces of the pair of upper and lower hemispherical members 23*a* and 23*b*. First and second gears 41 and 42 which are a pair of right and left gears having a large diameter composed of bevel gears opposed to each other are rotatably attached to both the ends of the support shaft 39 so as to be disposed at both right and left side locations of the hollow portion 37, third and fourth gears 43 and 44 which are a pair of upper and lower gears having a small diameter composed of bevel gears opposed to each other are rotatably attached to outer circumferences of a pair of upper and lower support shafts 34 and 35 so as to be located in upper and lower sections of the hollow portion 37, and the third and fourth gears 43 and 44 are engaged with upper and lower ends of both the first and second gears 41 and 42. The differential gear mechanism 38 is composed of the four first, second, third and fourth gears 41, 42, 43 and 44. Furthermore, a pair of upper and lower gears 45 and 46 are coupled with outer circumferences of boss portions 43*a* and 44*a* of the pair of third and fourth gears 43 and 44, and upper and lower ends of the pair of upper and lower hemispherical members 33*a* and 33*b* of the gear box 23 are rotatably supported on the outer circumferences of the pair of upper and lower boss portions 43*a* and 44*a* inside the pair of upper and lower gears 45 and 46.

An actuator 51 which drives this differential gear mechanism 38 is configured by a pair of right and left geared motors 52 and 53 horizontally attached to a rear surface of a motor mounting member 33*b* which is formed on the chassis 33 so as to be in parallel with the X axis and perpendicular to the chassis 33, and a pair of gear transmission mechanisms 54 and 55 which rotatingly drive the third and fourth gears 43 and 44 of the differential gear mechanism 38 with these geared motors 52 and 53 by way of the pair of upper and lower gears 45 and 46 integrated with the third and fourth gears 43 and 44. These gear transmission mechanisms 54 and 55 are configured by bevel gears 56*a* and 56*b*, gears 56*c* and 56*d*, bevel gears 57*a* and 57*b*, and gears 57*a* and 57*d*: the bevel gears 56*a* and 57*a* being fixed to output shafts 52*a* and 53*a* of the geared motors 52 and 53, whereas the other gears 56*b*, 56*c* and 56*d* and 57*b*, 57*c* and 57*d* being rotatably fitted over outer circumferences of three support shafts 58, 59 and 60 which are attached in parallel with the Y axis between a pair of upper and lower gear box mounting parts 33*a* of the chassis 33. In addition, the two gears 56*d* and 57*d* are commonly fitted over a top end and a bottom end of the support shaft 60.

In the center portion 37 of the gear box 23, a hemispherical slide guide 62 made of a molded synthetic resin material or the like and a pair of upper and lower prism like sliders 63 and 64 are built in parallel with each other between the first and second gears 41 and 42.

Speaking concretely, the slide guide 62 which is disposed perpendicularly to the X axis is rotatably attached to an outer circumference of the support shaft 39 and disposed at a location deviated toward the second gear 42, whereas the pair of upper and lower sliders 63 and 64 are built in parallel with each other between the slide guide 62 and the first gear 41 in a condition where the sliders 63 and 64 are arranged at the top and bottom of the support shaft 39 so as to be symmetrical and in parallel with each other. A pair of upper and lower guide rails 62*a* and 62*b* are molded integrally with side surfaces of the slide guide 62 on sides of the sliders 63 and 64 so as to be perpendicular to the X axis and in parallel with each other, and a pair of upper and lower guide grooves 63*a* and 63*b* which are formed in parallel with each other in side surfaces of the pair of sliders 63 and 64 on a side of the guide rail 62 are slidably engaged with the pair of upper and lower guide rails 62*a* and 62*b*. Accordingly, the pair of upper and lower sliders 63 and 64 are guided by the pair of upper and lower guide rails 62*a* and 62*b* so that the sliders can slide along the slide guide 62 in the directions indicated by the arrows e and f which are perpendicular to the X axis. A pair of upper and lower pin shaped wire driving parts 65 and 66 which are molded integrally with a side surface of the first gear 41 on a side of the sliders 63 and 64 are slidably engaged with a pair of upper and lower driven grooves 67 and 68 which are formed in deepest ends of side surfaces of the pair of upper and lower sliders 63 and 64 on a side of the first gear 41 in a direction perpendicular to a longitudinal direction of the sliders. These pair of upper and lower wire driving parts 65 and 66 are disposed at an identical radial direction from the X axis and opposed to each other at an angle of 180°.

An elongated opening 70 which has an elongated shape in parallel with the Y axis is formed in a front surface of the gear box 23, and the slide guide 62 and the pair of upper and lower sliders 63 and 64 protrude forward from the gear box 23 through the elongated opening 70. The nearly L shaped driven ends 24*d* and 24*e* of the two wire portions 24*a* and 24*b* of the wire 24 are fitted and fixed in a pair of upper and lower wire fitting grooves 63*b* and 64*b* which are formed in the pair of upper and lower sliders 63 and 64 so as to be in parallel with bottom surfaces of a pair of upper and lower guide grooves 63*a* and 64*a* and in shapes having terminal ends bent in symmetrical L shapes. Upper and lower end edges of the elongated opening 70 of the gear box 23 are configured as a pair of upper and lower stoppers 71 and 72 which stop the curving mechanism 21 at the upper and lower swing limit positions P3 and P4. An end of the cylinder 26*d* at the base end of the cylindrical member 25 which composes the base end 21*b* of the curving mechanism 21 is kept by the spherical seat 27*b* in contact with a spherical surface which is an outer circumferential surface of the gear box 23 so as to be rotatable in the directions indicated by the arrows a1 and a2.

When the base unit 22 which has the above described configuration drives the pair of gears 45 and 46 disposed over and below the gear box 23 with the two geared motors 52 and 53 of the actuator 51 shown in FIGS. 7 through 11 by way of the gear transmission mechanisms 54 and 55, the third and fourth gears 43 and 44 of the differential gear mechanism 38 in the gear box 23 are driven together with these gears 45 and 46.

The differential gear mechanism 38 is configured so that the first and second gears 41 and 42 are simultaneously rotatingly driven in the gear box 23 in the directions indicated by the arrows a1 and a2 which are opposed to each other, and the curving mechanism 21 is swingingly driven in the direction of the arrow a1 or a2 by the rotation of the first gear 41 in the direction of the arrow a1 or a2 when the third and fourth gears 43 and 44 are rotatingly driven simultaneously in the directions indicated by the arrows b2 and b1 or b1 and b2 which are opposite to each other. Furthermore, the differential gear mechanism 38 is configured so that the gear box 23 is swingingly driven as a whole around the Y axis along the pair of upper and lower support shafts 34 and 35 in the direction of the arrow b1 or b2 which is the right-left direction by way of the first and second gears 41 and 42 and the support shaft 39, and the curving mechanism 21 is swingingly driven together with the gear box 23 in the direction of the arrow b1 or b2 when the third and fourth gears 43 and 44 are rotatingly driven simultaneously in an identical direction which is indicated by the arrow b1 or b2.

Figure 15:
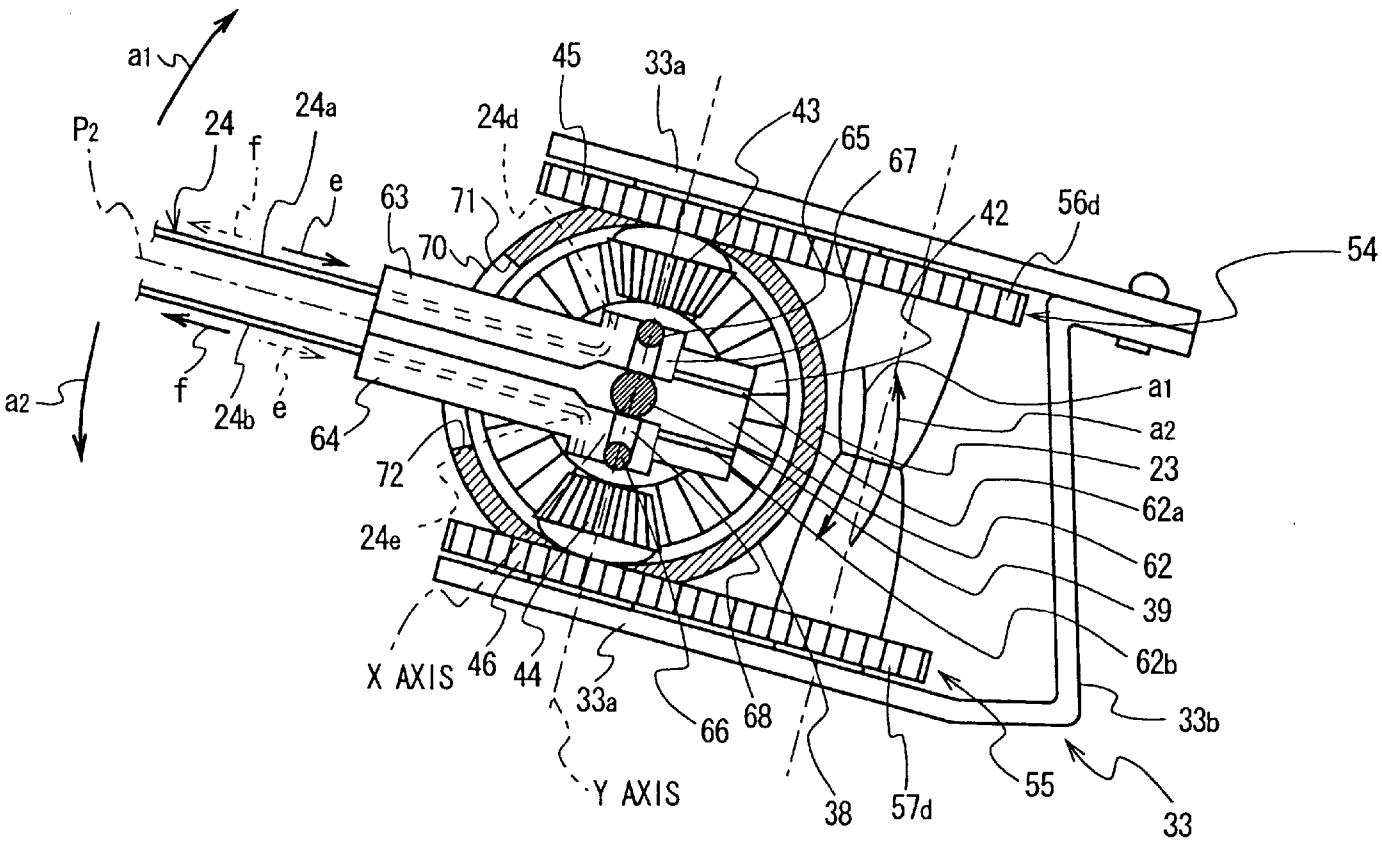
FIG. 15 is a sectional side view taken along a C—C line in FIG. 10 showing, on an enlarged scale, the differential gear mechanism portion and a pair of upper and lower sliders shown in FIG. 12.
Figure 18:
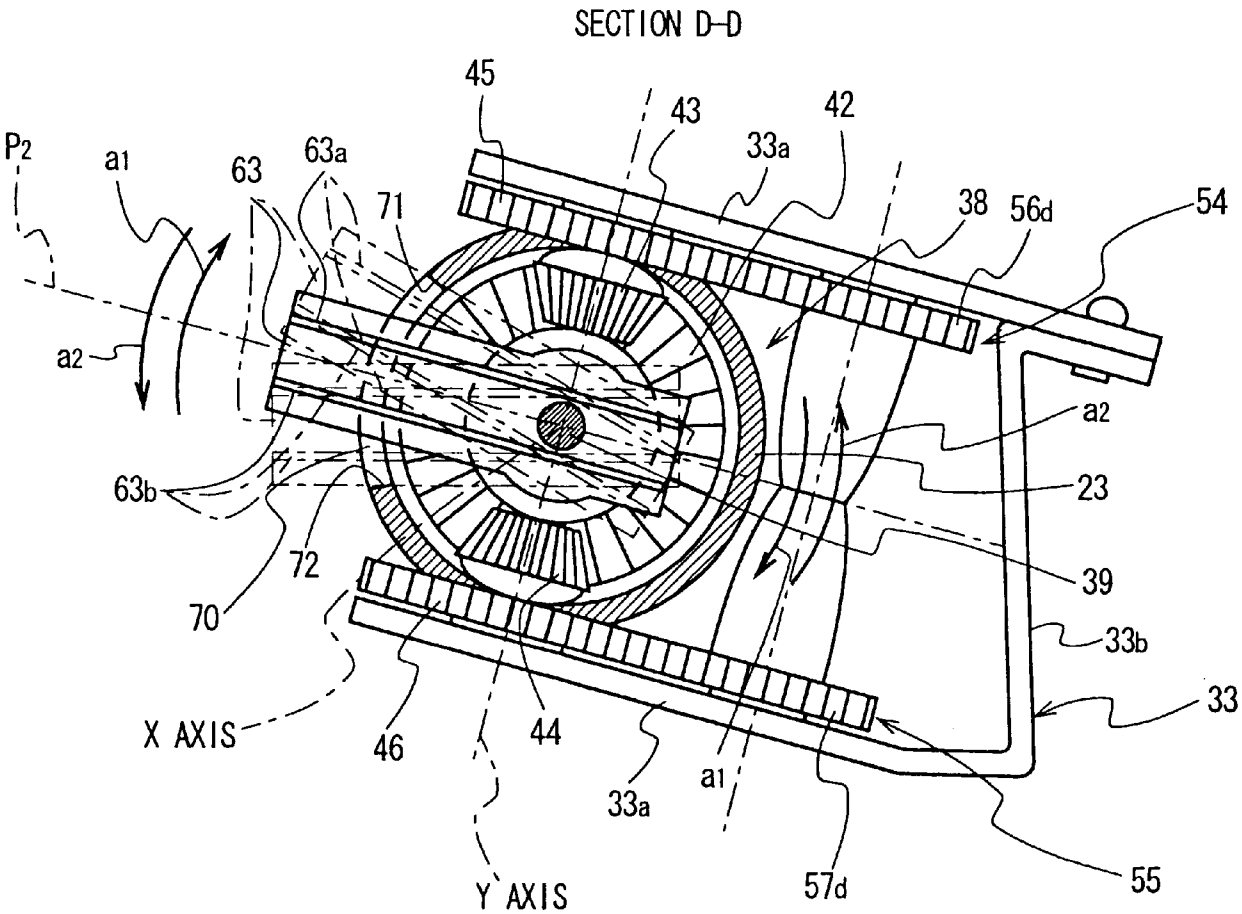
FIG. 18 is a sectional side view taken along a D—D line in FIG. 10 showing, on an enlarged scale, a slide guide which is rotatingly driven in the up-down direction together with the differential gear mechanism portion and the above pair of upper and lower sliders.
Figure 19:
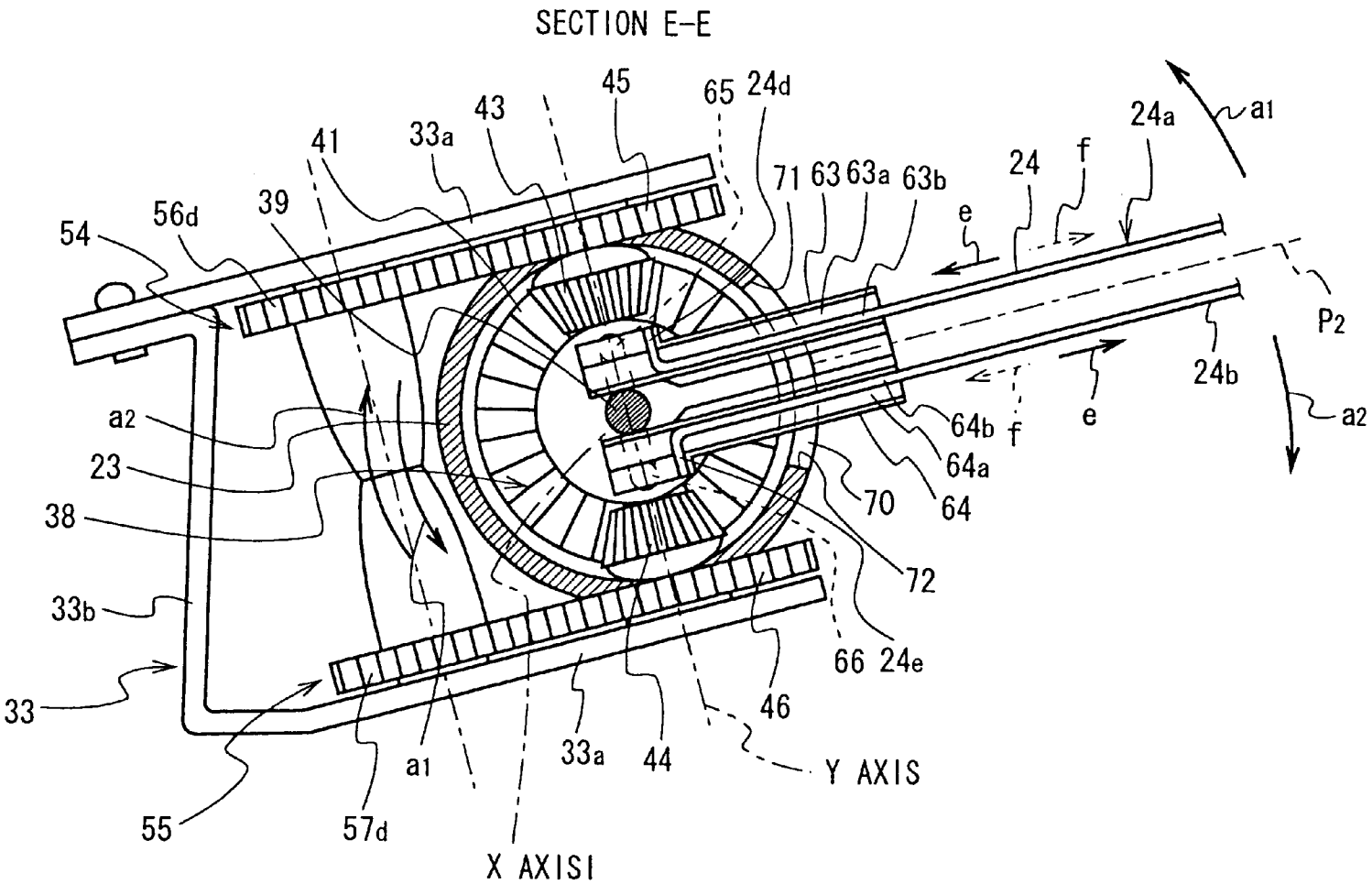
FIG. 19 is a sectional side view taken along an E—E line in FIG. 10 showing, on an enlarged scale, the differential gear mechanism portion and the pair of upper and lower sliders shown in FIG. 12 which are seen from a side opposite to that in FIG. 15.

Speaking concretely, when the curving mechanism 21 is located at a swing center position P2 in the up-down direction as shown in FIG. 12, the pair of upper and lower wire driving parts 65 and 66 of the first gear 41 are positioned on the Y axis and at upper and lower locations which are symmetrical with regard to the X axis as shown in FIGS. 15, 18 and 19, and the guide rail 62 and the pair of upper and lower sliders 63 and 64 are positioned at the swing center position P2. When the first gear 41 is rotatingly driven around the support shaft 39 in the direction indicated by the arrow a1 or a2, the pair of upper and lower wire driving parts 65 and 66 of the first gear 41 are simultaneously rotated around the support shaft 39 in the direction indicated by the arrow a1 or a2, whereby the pair of upper and lower driving parts 65 and 66 rotatingly drive the driven parts 67 and 68 of a pair of upper and lower sliders 63 and 64 in the direction indicated by the arrow a1 or a2.

At this time, thrust forces in the directions indicated by the arrows e and f which are opposite to each other are applied from the pair of upper and lower wire driving parts 65 and 66 to the pair of upper and lower sliders 63 and 64 as indicated by arrows traced in solid lines or dotted lines in FIGS. 15 and 19, whereby these sliders 63 and 64 are to be slid along the pair of upper and lower guide rails 62*a* and 62*b* of the slide guide 62 in the directions indicated by the arrows e and f. However, the thrust forces in the directions indicated by the arrows e and f are weak and cancelled with an elastic repulsive force of the tip 24*c* of the wire portions 24*a* and 24*b* though the thrust forces are transmitted in the axial direction of the two wire portions 24*a* and 24*b* which are nearly in parallel with each other from the pair of upper and lower sliders 63 and 64 by way of the two driven ends 24*d* and 24*e* of the wire 24. As a result, the repulsive elastic force prevents at this time the pair of upper and lower sliders 63 and 64 from sliding along the slide guide 62 in the directions indicated by the arrows e and f, and the pair of upper and lower sliders 63 and 64 are rotatingly driven smoothly together with the slide guide 62 around the support shaft 39 in the elongated opening 70 of the gear box 23 in the direction indicated by the arrow a1 or a2 by way of the pair of upper and lower guide grooves 63*a* and 64*a* as well as the guide rails 62*a* and 62*b*.

The two wire portions 24*a* and 24*b* are rotatingly driven on the vertical plane around the X axis in the direction indicated by the arrow a1 or a2 while maintaining the nearly parallel condition of the two wire portions 24*a* and 24*b* with the pair of upper and lower driven ends 24*d* and 24*e* which are fixed to the pair of upper and lower sliders 63 and 64 as shown FIG. 12, whereby the curving mechanism 21 is swingingly driven together with the wire portions 24*a*, 24*b* and the cylindrical member 25 in the up-down direction indicated by the arrow a1 or a2 from the swing center position P2 to the upper swing limit position P3 or the lower swing limit position P4 as shown in FIG. 1.

When the curving mechanism 21 is rotated in the direction indicated by the arrow a1 or a2 to the upper swing limit position P3 or the lower swing limit position P4, the slide guide 62 is brought into contact with the upper stopper 71 or the lower stopper 72 of the elongated opening 70 of the gear box 23 from the direction indicated by the arrow a1 or a2 and stopped as indicated by a single-dot chain line or a two-dot chain line in FIG. 18.

Now, description will be made of operations to curve the tip 21*a* of the curving mechanism 21 in the direction indicated by an arrow a1' after the curving mechanism 21 has been rotated in the direction indicated by the arrow a1 from the swing center position P2 in the up-down direction to the upper swing limit position P3.

Figure 13:
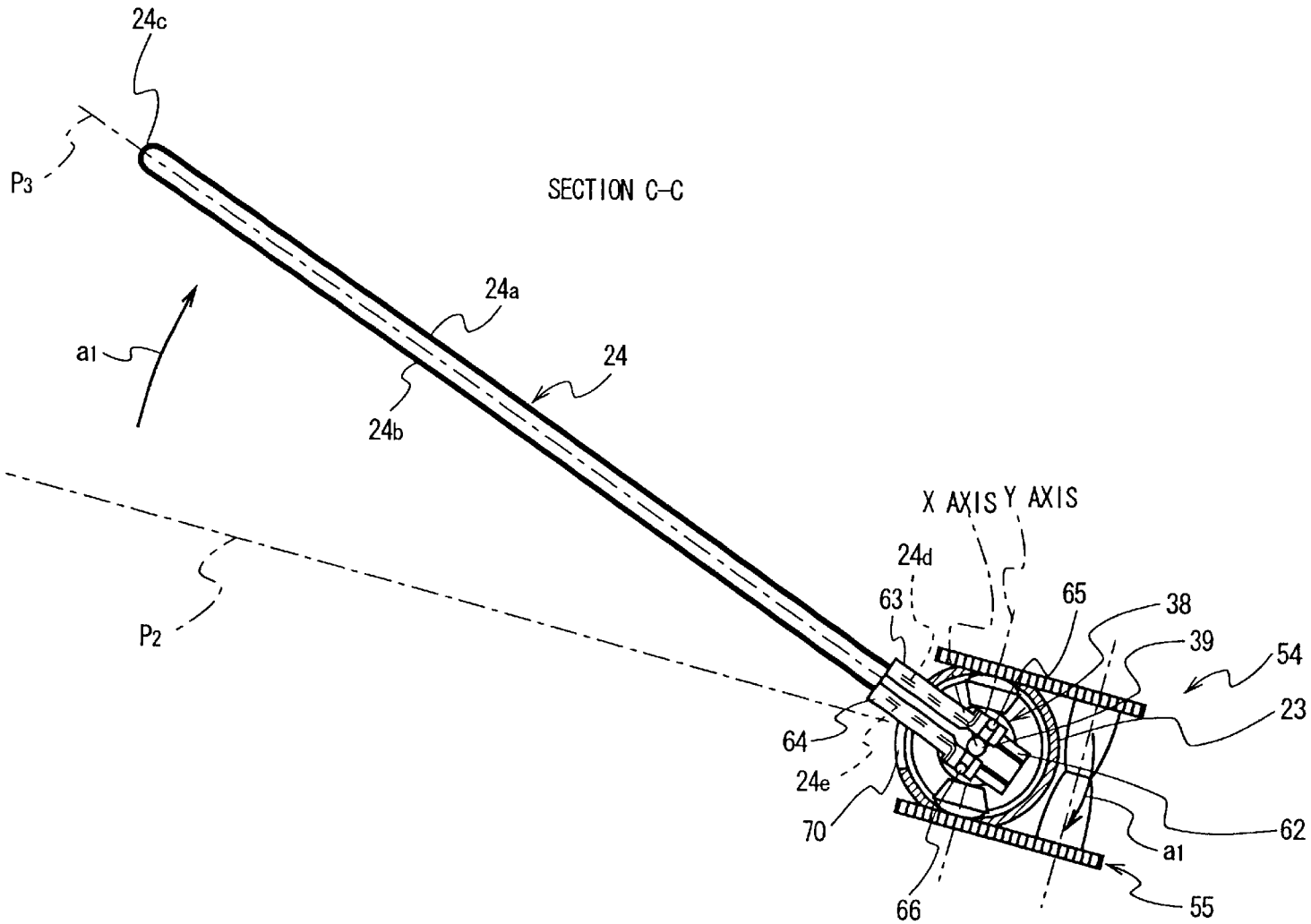
FIG. 13 is a sectional side view similar to FIG. 12 showing a condition where the curving mechanism shown in FIG. 12 is rotatingly driven from the swing center position in the up-down direction to an upper swinging limit position.
Figure 16:
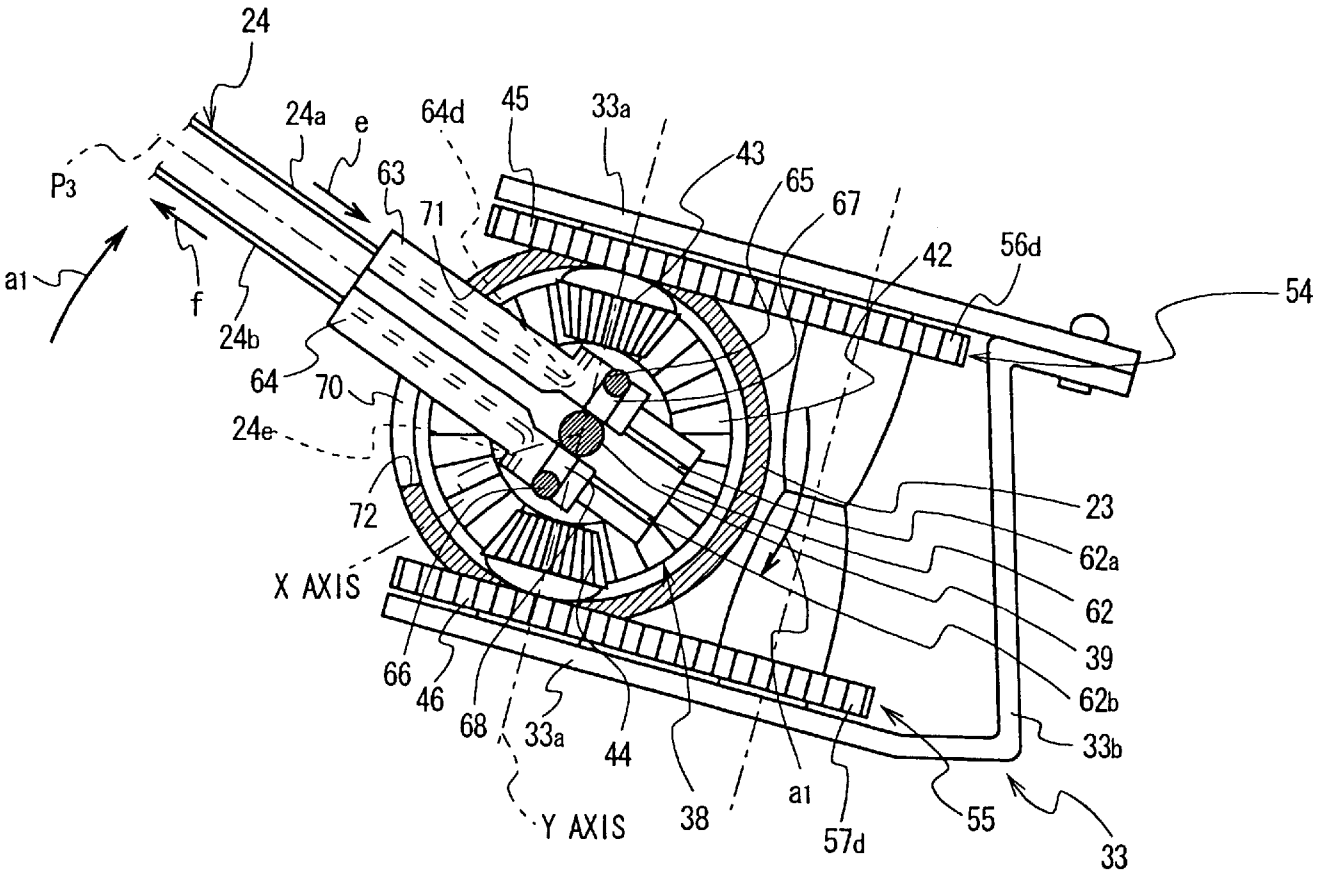
FIG. 16 is a sectional side view similar to FIG. 15 showing, on an enlarged scale, the differential gear mechanism portion and a pair of upper and lower sliders shown in FIG. 13.
Figure 20:
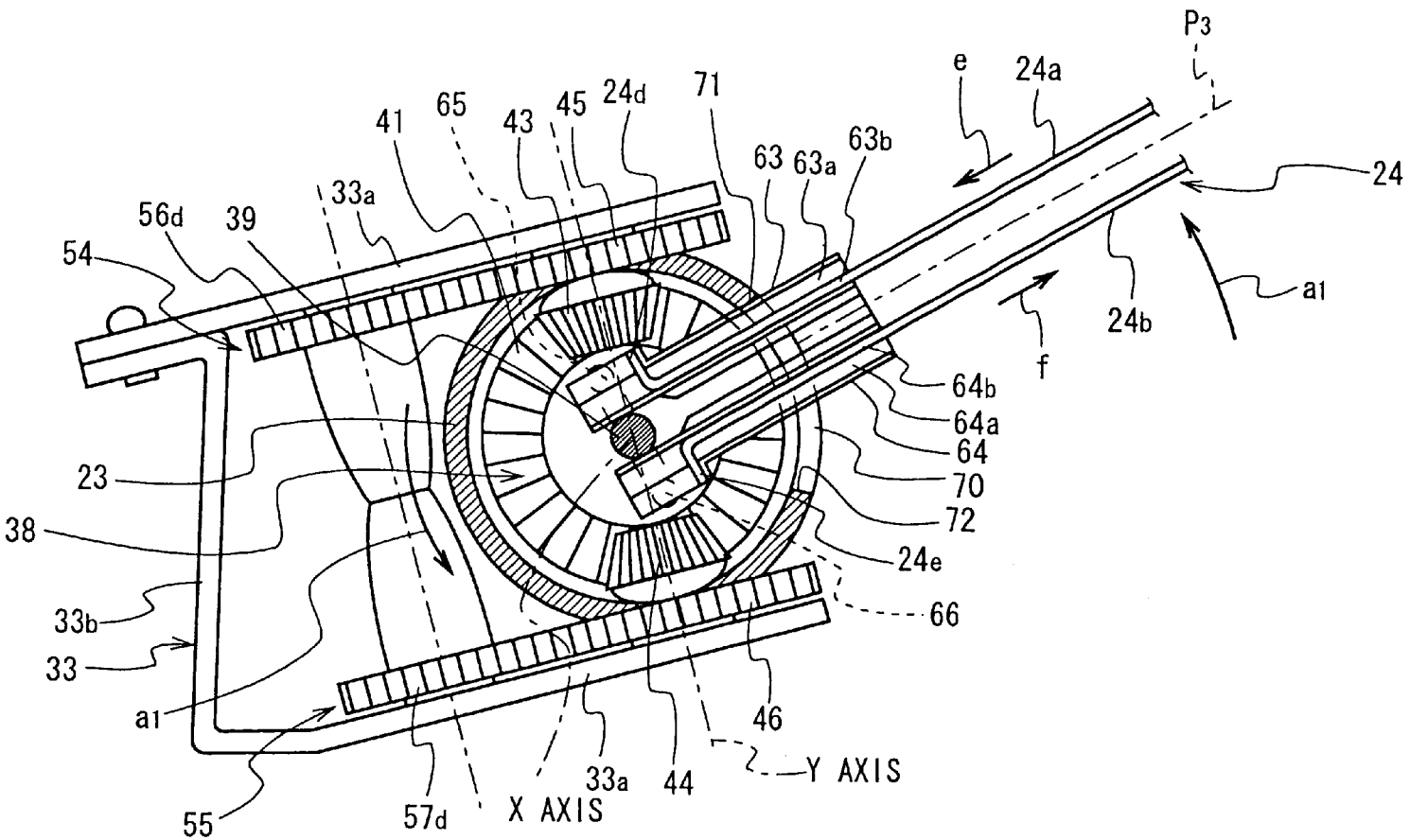
FIG. 20 is a sectional side view similar to FIG. 19 showing, on an enlarged scale, the differential gear mechanism portion and the pair of upper and lower sliders shown in FIG. 13 which are seen in a direction opposite to that in FIG. 16.

When the curving mechanism 21 is rotated in the direction indicated by the arrow a1 from the swing center position P1 in the up-down direction shown in FIG. 12 to the upper swing limit position P3 shown in FIG. 13 by rotating the pair of upper and lower sliders 63 and 64 together with the slide guide 62 in the direction indicated by the arrow a1 in the elongated opening 70 of the gear box 23 with the pair of upper and lower wire driving parts 65 and 66 of the first gear 41 as shown in FIGS. 15, 18 and 19, the slide guide 62 is brought into contact with the upper stopper 71 of the elongated opening 70 of the gear box 23 from the direction indicated by the arrow a1 and stopped as indicated by a single-dot chain line in FIG. 18, and the pair of upper and lower sliders 63 and 64 are stopped together with the slide guide 62 at the upper swing limit position P3 as shown in FIGS. 16 and 20. However, the first gear 41 is rotatingly driven successively in the direction indicated by the arrow a1, whereby the pair of upper and lower wire driving parts 65 and 66 are rotatingly driven successively around the support shaft 39 in the direction indicated by the arrow a1.

Figure 17:
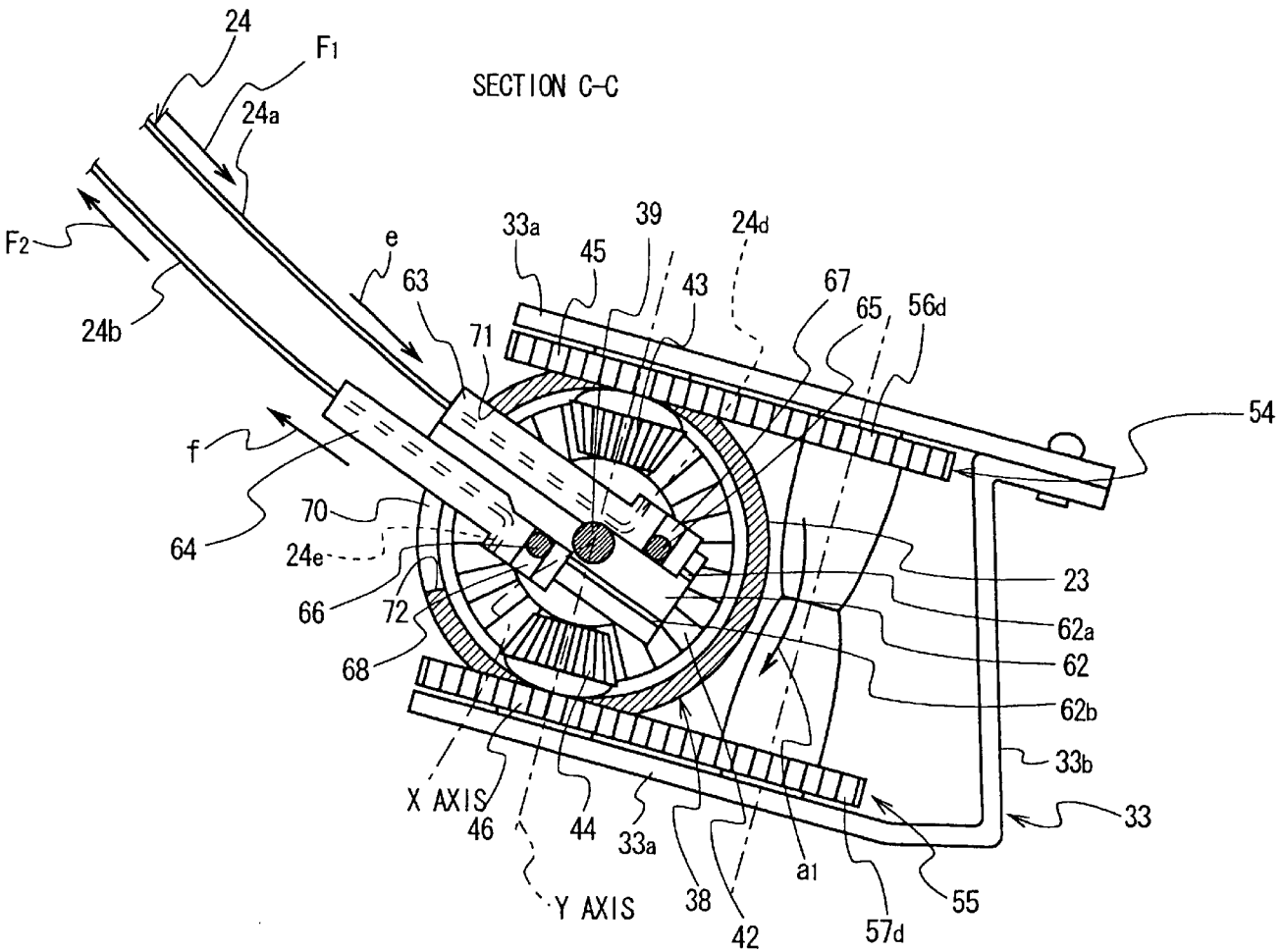
FIG. 17 is a sectional side view similar to FIG. 16 showing, on an enlarged scale, the differential gear mechanism portion and the pair of upper and lower sliders shown in FIG. 14.
Figure 21:
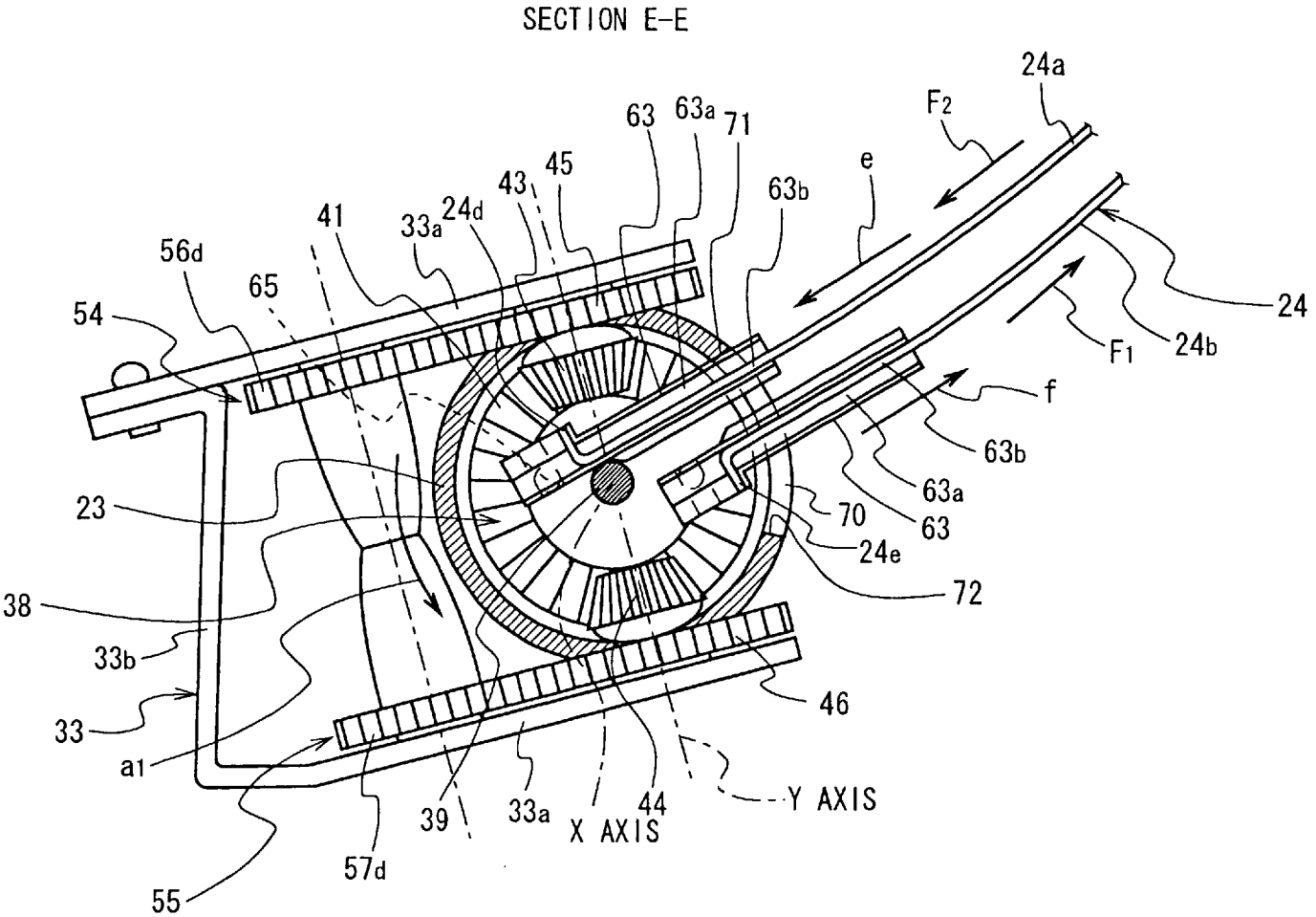
FIG. 21 is a sectional side view similar to FIG. 20 showing, on an enlarged scale, the differential gear mechanism portion and the pair of upper and lower sliders shown in FIG. 14 which are seen in a direction opposite to that in FIG. 17.

At this time, the pair of upper and lower wire driving parts 65 and 66 rotatingly drive the pair of upper and lower driven grooves 67 and 68 of the pair of upper and lower sliders 63 and 64 in the direction indicated by the arrow a1 in a condition where the slide guide 62 is brought into contact with the upper stopper 71 from the direction indicated by the arrow a1 and stopped as shown in FIGS. 17 and 21, whereby the pair of upper and lower sliders 63 and 64 are forcibly driven by the pair of upper and lower wire driving parts 65 and 66 to slide along the pair of upper and lower guide rails 62*a* and 62*b* of the slide guide 62 in the directions indicated by the arrows e and f which are opposite to each other. The pair of upper and lower driven ends 24*d* and 24*e* of the wire 24 are driven reversibly and forcibly (movingly controlled) to slide together with the pair of upper and lower sliders 63 and 64 in the directions indicated by the arrows e and f, thereby simultaneously applying the pulling force F1 in the direction indicated by the arrow e and the pushing force F2 in the direction indicated by the arrow f in the axial direction of the two wire portions 24*a* and 24*b* which are nearly in parallel with each other. As a result, the tip 24*c* of the two wire portions 24*a* and 24*b* of the wire 24 autonomously curves in the direction indicated by the arrow a1' due to the moment M1 as described with reference to FIGS. 1, 3 and 14, whereby the tip 21*a* of the curving mechanism 21 is autonomously curved together with the wire 24 and the cylindrical member 25 from the upper swing limit position P3 in the direction indicated by the arrow a1'.

When the tip 21*a* of the curving mechanism 21 is to be curved in the direction indicated by the arrow a2' after the curving mechanism 21 has been rotated in the direction indicated by the arrow a2 from the swing center position P2 in the up-down direction to the lower swing limit position P4, the first gear 41 is rotatingly driven successively in the direction indicated by the arrow a2 after the slide guide 62 is brought into contact with the lower stopper 72 of the elongated opening 70 of the gear box 23 from the direction indicated by the arrow a2 and is stopped, whereby the pair of upper and lower wire driving parts 65 and 66 forcibly drive (movingly control) the pair of upper and lower driven ends 24*d* and 24*e* of the wire 24 together with the pair of upper and lower sliders 63 and 64 to slide along the pair of upper and lower guide rails 62*a* and 62*b* of the slide guide 62 in the directions indicated by the arrows f and e in the direction opposite to a curving action in the direction indicated by the arrow a1' described above, as indicated by a two-dot chain line in FIG. 18. Then, the pushing force F2 in the direction indicated by the arrow f and the pulling force F1 in the direction indicated by the arrow e are applied simultaneously in the axial direction of the two wire portions 24*a* and 24*b* which are nearly in parallel as described with reference to FIGS. 1 and 3, whereby the tip 24*c* of the wire 24 autonomously curves in the direction indicated by the arrow a2' due to the moment M2 and the tip 21*a* of the curving mechanism 21 is autonomously curved together with the wire 24 and the cylindrical member 25 from the lower swing limit position P4 in the direction indicated by the arrow a2'.

Figure 22:
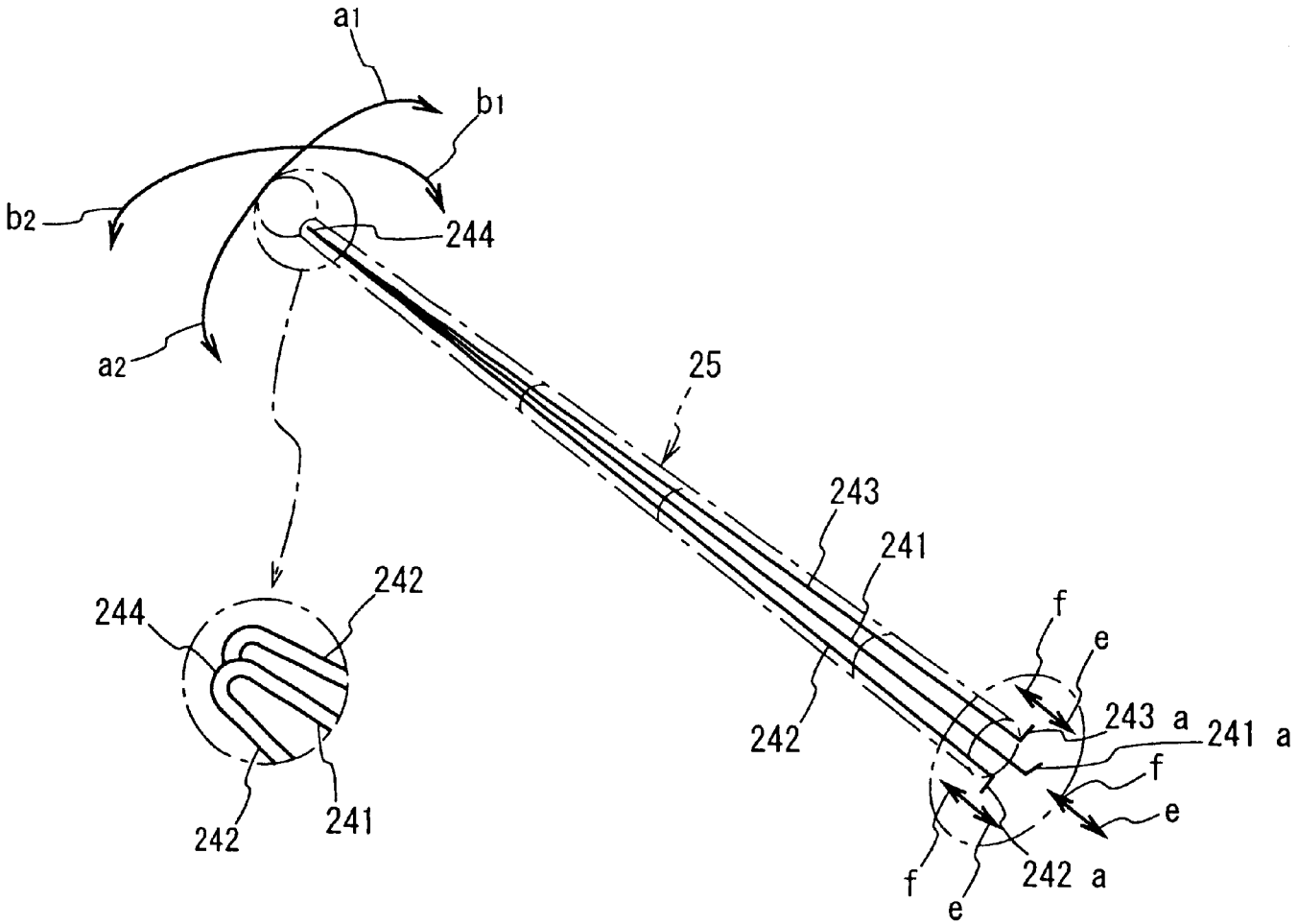
FIG. 22 is a schematic perspective view descriptive of a second embodiment of the curving mechanism according to the present invention.

Describing a second embodiment of the curving mechanism 21 with reference to FIG. 22, tips 244 of a plurality of wires, or three wires 241, 242 and 243, are coupled with one another from three directions, a cylindrical member 25 is fitted over outer circumferences of the three wires 241, 242 and 243, and three driven ends 241*a*, 242*a* and 243*a* which are base ends on a side opposite to the tips of the three wires 241, 242 and 243 are movingly controlled selectively in directions indicated by arrows e and f which are axial directions of these wires 241, 242 and 243 so that the tips 244 of these wires 241, 242 and 243 can be swung in two directions indicated by arrows a1 and a2 which are perpendicular to each other within a range of 360°.

The embodiments of the present invention which have been described above are illustrative of the present invention and can be modified in various ways on the basis of a technical concept of the present invention. The two geared motors 52 and 53 which are used in the actuator 51, for example, can be substituted for a piston mechanism which is driven by a hydraulic pressure, a pneumatic pressure or the like and the differential gear mechanism 38 which rotatingly drives the curving mechanism 21 around the X axis and the Y axis in the two directions perpendicular to each other can be substituted for two actuators which are disposed in series. Furthermore, the number of the wires 24 may be two, three or more, the cylindrical member 25 which can be curved may be a member made of a material such as rubber or a plastic material which has elasticity (flexibility), and when the cylindrical member 25 is to be configured by the plurality of cylinders 26*a* through 26*d* or the like made of a material which is not elastic, the plurality of joints 27 can be substituted for various kinds of universal joints other than the spherical surfaces 27*a* and the spherical seats 27*b*. Furthermore, the curving mechanism 21 is applicable not only to the tail 5 of the pet robot 1 but also to leg members and other various kinds of joint parts and the like of various kinds of miniature robots and the like.

Industrial Applicability

The curving mechanism and the pet robot are applicable to amusement robots, assistant robots and the like.

What is claimed is:

1. A curving mechanism comprising:

a cylindrical member which can be curved having a plurality of jointed sections which are bendably connected and rotatable relative to one another;

an elastic continuous wire member extending through and between each of the plurality of jointed sections with said wire member having a tip at one end thereof whereby said cylindrical member is fitted over the entire outer circumference of said continuous wire member; and an actuator which selectively moves and controls driven base ends formed on an end of said wire member opposite to said top in an axial direction of the wire member as to move the plurality of joined sections.

2. A robot having a curving mechanism which comprises:

a cylindrical member which can be curved having a plurality of jointed sections which are bendably connected and rotatable relative to one another;

an elastic continuous wire member extending through and between each of the plurality of jointed sections and said wire member having a tip at one end thereof whereby said cylindrical member is fitted over the entire outer circumference of said continuous wire member; and an actuator which selectively moves and controls driven base ends on a side of said wire member opposite to said tip in an axial direction of the wire member so as to move the plurality of jointed sections.

3. The robot of claim 2 wherein the curving mechanism is built in a tail which forms the jointed member.

4. A curving mechanism comprising:

an elastic wire member having a pair of wire portions which are connected at a generally curved forming a tip portion of said pair of wire portions;

a cylindrical member which is fitted over an outer circumferential portion of said pair of wire portions and which can be curved; and an actuator which rotates and controls two driven ends on a side of said wire member opposite to said tip portion of said pair of wire portions simultaneously in a direction perpendicular to an axial direction of the wire portions and reversibly moves and controls said driven ends in the axial direction of the wire portions.

5. A curving mechanism comprising:

an elastic wire member having a pair of wire portions which are connected at a generally curved portion forming a tip portion of said pair of wire portions;

a jointed cylindrical member which is fitted over an outer circumferential portion of said pair of wire portions and which can be curved; and an actuator which rotates and controls two driven ends on a side of said wire member opposite to said tip portion of said pair of wire portions simultaneously in a direction perpendicular to an axial direction of the wire portions and reversibly moves and controls said driven ends in the axial direction of the wire portions.

6. A curving mechanism comprising:

an elastic wire member having a pair of wire portions which are connected at a generally curved portion forming a tip portion of said pair of wire portions;

a jointed cylindrical member which is fitted over outer circumferences of said pair of wire portions and which can be curved in two directions perpendicular to an axial direction of said wire portions, an actuator which rotatably controls two driven ends on a side of said wire member opposite to said tip portion of said pair of wire portions in two directions perpendicular to an axial direction of the wire portions and reversibly movably controls said driven ends in the axial direction of said wire portions.

7. A curving mechanism comprising:

an elastic wire member having a pair of wire portions which are connected at a generally curved portion forming a tip portion of said pair of wire portions;

a cylindrical member which is fitted over outer circumferences of said pair of wire portions and which can be curved in two directions perpendicular to an axial direction of said wire portions;

a gear box supported rotatably around a first center of rotation;

a differential gear mechanism which is built in said gear box, and comprises first and second gear members which are disposed with a spacing interposed at a second center of rotation perpendicular to said first center of rotation, and third and fourth gear members which are disposed at said first center of rotation with a spacing interposed and engaged with said first and second gear members;

a slide guide which is disposed between said first and second gear members and rotatable around said first center of rotation;

two sliders which are disposed between said first and second gear members and are slidable along said slide gear in a direction perpendicular to said second center of rotation, and to which two driven ends disposed on a side of said wire portions opposite to said tip portion are fixed;

two wire driving part members which are formed on surfaces of said first and second gear members opposed to each other and engaged with said two sliders;

two stop members which are disposed in said gear box and restrict an amount of rotation of said slide guide around said first center of rotation; and an actuator which rotatably drives said first and second gear members around said second center of rotation in said gear box by way of the third and fourth gear members of said differential gear mechanism, and rotatably drives said first and second gear members around said first center of rotation together with said gear box.

* * * * *